US006858811B2

(12) United States Patent
Fitzgerald et al.

(10) Patent No.: US 6,858,811 B2
(45) **Date of Patent: *Feb. 22, 2005**

(54) BINARY SWITCH APPARATUS AND METHOD FOR MANUFACTURING SAME

(75) Inventors: Sanford G. Fitzgerald, Tulsa, OK (US); Toby E. Smith, Broken Arrow, OK (US); Craig L. Cooper, Inola, OK (US); Margaret S. Blaker, Tulsa, OK (US); Richard R. Keck, Porter, OK (US)

(73) Assignee: Bed-Check Corporation, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/701,581

(22) Filed: Nov. 5, 2003

(65) Prior Publication Data

US 2004/0144635 A1 Jul. 29, 2004

Related U.S. Application Data

(63) Continuation-in-part of application No. 09/878,088, filed on Jun. 7, 2001, now Pat. No. 6,696,653.

(51) Int. Cl.[7] ..... H01H 3/14

(52) U.S. Cl. ..... 200/85 R; 200/86 A; 340/573

(58) Field of Search ..... 200/85 R, 86 A, 200/61.44, 61.62, 61.7, 61.73; 340/573, 667, 529, 523

(56) References Cited

U.S. PATENT DOCUMENTS 3,812,313 A 5/1974 Wolf et al.
4,179,692 A * 12/1979 Vance
4,295,133 A * 10/1981 Vance
4,446,345 A * 5/1984 Sheiry
4,484,043 A * 11/1984 Musick et al.
4,565,910 A * 1/1986 Musick et al.
4,589,942 A * 5/1986 Korinek
4,700,180 A * 10/1987 Vance
4,889,668 A * 12/1989 Kemp
5,142,109 A * 8/1992 O'Meara, Jr. et al.
5,191,181 A * 3/1993 Regenscheid
5,489,356 A * 2/1996 Drower
5,554,835 A * 9/1996 Newham
5,600,108 A * 2/1997 Newham
5,623,760 A * 4/1997 Newham ..... 29/622
5,633,627 A * 5/1997 Newham ..... 340/573.4
5,640,145 A * 6/1997 Newham ..... 340/573.1
5,654,694 A * 8/1997 Newham ..... 340/573.1
5,967,299 A 10/1999 de Richecour et al.
6,013,882 A * 1/2000 Boetzkes ..... 200/86.5
6,099,771 A * 8/2000 Hudkins et al. ..... 264/102
6,258,395 B1 * 7/2001 Kershman et al. ..... 426/496
6,281,455 B1 * 8/2001 Plottnik et al. ..... 200/61.44
6,307,476 B1 * 10/2001 Smith et al. ..... 340/573.1

FOREIGN PATENT DOCUMENTS

DE 19802099 A1 7/1998

* cited by examiner

*Primary Examiner*—Kyung Lee
(74) *Attorney, Agent, or Firm*—Fellers, Snider, Blankenship, Bailey & Tippens, P.C.; Terry L. Watt

(57) ABSTRACT

The present invention relates generally to methods and apparatus for the manufacture of binary switches for use in the medical monitoring field and membrane switches for use in a variety of contexts. More particularly, the instant invention involves the construction, manufacture, and operation of pressure sensitive patient sensors of the sort commonly used in medical settings which can be used, for example, to detect when a patient has exited a chair or a bed. The instant application additionally teaches the construction of membrane switches for use in, for example, electronic instrument control panels. Both the binary switches and membrane switches taught herein are preferably formed from alternating layers of polyester and polyethylene.

19 Claims, 13 Drawing Sheets

BINARY SWITCH APPARATUS AND METHOD FOR MANUFACTURING SAME

This application is a continuation-in-part application of U.S. patent application Ser. No. 09/878,088, filed Jun. 7, 2001 now U.S. Pat. No. 6,696,653, which application is incorporated herein by reference.

FIELD OF THE INVENTION

The present invention relates generally to binary switches for use in the medical monitoring and other fields and to methods for manufacturing same. More particularly, the instant invention involves the construction, manufacture, and operation of pressure actuated switches of the sort commonly used to detect when a patient has, for example, left a chair or a bed and, more generally, in other settings where membrane-type switches would be useful including use as part of the user interface in a piece of electronic equipment.

BACKGROUND OF THE INVENTION

It is well documented that the elderly and post-surgical patients are at a heightened risk of falling. These individuals are often afflicted by gait and balance disorders, weakness, dizziness, confusion, visual impairment, and postural hypotension (i.e., a sudden drop in blood pressure that causes dizziness and fainting), all of which are recognized as potential contributors to a fall. Additionally, cognitive and functional impairment, and sedating and psychoactive medications are also well recognized risk factors.

A fall places the patient at risk of various injuries including sprains, fractures, and broken bones—injuries which in some cases can be severe enough to eventually lead to a fatality. Of course, those most susceptible to falls are often those in the poorest general health and least likely to recover quickly from their injuries. In addition to the obvious physiological consequences of fall-related injuries, there are also a variety of adverse economic and legal consequences that include the actual cost of treating the victim and, in some cases, caretaker liability issues.

In the past, it has been commonplace to treat patients that are prone to falling by limiting their mobility through the use of restraints, the underlying theory being that if the patient is not free to move about, he or she will not be as likely to fall. However, research has shown that restraint-based patient treatment strategies are often more harmful than beneficial and should generally be avoided—the emphasis today being on the promotion of mobility rather than immobility. Among the more successful mobility-based strategies for fall prevention include interventions to improve patient strength and functional status, reduction of environmental hazards, and staff identification and monitoring of high-risk hospital patients and nursing home residents.

Of course, direct monitoring of high-risk patients, as effective as that care strategy might appear to be in theory, suffers from the obvious practical disadvantage of requiring additional staff if the monitoring is to be in the form of direct observation. Thus, the trend in patient monitoring has been toward the use of electrical devices to signal changes in a patient's circumstance to a caregiver who might be located either nearby or remotely at a central monitoring facility, such as a nurse's station. The obvious advantage of an electronic monitoring arrangement is that it frees the caregiver to pursue other tasks away from the patient. Additionally, when the monitoring is done at a central facility a single person can monitor multiple patients which can result in decreased staffing requirements.

Generally speaking, electronic monitors work by first sensing an initial status of a patient, and then generating a signal when that status changes, e.g., he or she has sat up in bed, left the bed, risen from a chair, etc., any of which situations could pose a potential cause for concern in the case of an at-risk patient. Electronic bed and chair monitors typically use a pressure sensitive switch in combination with a separate electronic monitor which conventionally contains a microprocessor of some sort. In a common arrangement, a patient's weight resting on a pressure sensitive mat (i.e., a "sensing" mat) completes an electrical circuit, thereby signaling the presence of the patient to the microprocessor. When the weight is removed from the pressure sensitive switch, the electrical circuit is interrupted, which fact is similarly sensed by the microprocessor. The software logic that drives the monitor is typically programmed to respond to the now-opened circuit by triggering some sort of alarm—either electronically (e.g., to the nursing station via a conventional nurse call system) or audibly (via a built-in siren) or both. Additionally, many variations of this arrangement are possible and electronic monitoring devices that track changes in other patient variables (e.g., wetness/enuresis, patient activity, etc.) are available for some applications.

General information relating to mats for use in patient monitoring may be found in U.S. Pat. Nos. 4,179,692, 4,295,133, 4,700,180, 5,600,108, 5,633,627, 5,640,145, and 5,654,694 (concerning electronic monitors generally). Additional information may be found in U.S. Pat. Nos. 4,484,043, 4,565,910, 5,554,835, and 5,623,760 (switch patents), the disclosures of all of which are all incorporated herein by reference.

By way of general background, in a typical arrangement, a pressure-sensing mat of the sort discussed herein is a sealed "sandwich" composed of three layers: two outer layers and an inner (central) layer positioned between the two outer layers. The outer layers are usually made of some sort of plastic and are impermeable to fluids and electrically non-conductive on their outer faces, where "outer" is determined with respect to the middle layer. The inner surface of each of the outer layers—which inner surfaces are oriented to face each other from opposite sides of the central layer—is made to be electrically conductive, usually by printing a conductive (e.g., carbon-based) ink on that surface. The compressible middle "central spacer" is made of a non-conductive material and serves to help keep the two conductive faces apart when a patient is not present on the sensor. The central spacer is discontinuous, which makes it possible for the two conductive inner surfaces to be forced into contact through the one or more discontinuities when weight is applied to the switch. By attaching a separate electrical lead to each of the conductive inner faces, it can readily be determined via a simple continuity (or low voltage) check whether a weight is present on the sensor (e.g., a patient is seated thereon). Removal of the weight causes the central spacer to expand and press apart the two conducting faces, thereby breaking the electrical connection between them. Thus, a device that monitors the resistance across the two electrical leads may determine when a patient has moved from a seated or prone position.

One disadvantage of the current generation of pressure sensitive mats is that they cannot be completely (e.g., hermetically) sealed around their perimeters against the external environment. The reason for this should be clear: if the interior of the mat were completely sealed, air pressure inside of the mat would tend to oppose the urging of the mat faces into contact, thereby making it difficult or impossible to complete the circuit (e.g., think of compressing an "air pillow"). Of course, the fact that the interior of the mat must be kept open to the atmosphere results in a mat that is highly susceptible to invasion by bodily fluids or cleaning solutions, as the in-rushing air that enters when the switch expands tends to carry fluids along with it into the interior of the mat. Further, it is well known that some common disinfecting cleaners can loosen the adhesives that hold the layers of a conventional mat together, thereby ruining the sensor. Thus, cleaning soiled mats becomes problematic. In summary, what is needed is a pressure sensitive mat that is more resistant to invasion by fluids than has heretofore been available.

Methods of manufacturing conventional pressure sensitive mats for use in medical applications of this sort of sensing device typically begin at a single station punch, wherein the upper and lower plastic/nonconductive members are cut from a larger sheet of material. This step would typically be followed by the application of a conductive material to one face of each member. For example, the conductive material could be printed onto the surface using a carbon-based ink, although other variations have been employed. A popular alternative method involves the use sheets or rolls of material on which the conductor has been pre-applied.

The inner non-conductive member may be a discrete layer of material that has dimensions somewhat smaller than those of the exterior member, or it could take the form of a pattern of non-conductive raised ridges or dots which is deposited on top of the ink (the raised ridges separating the two conductive faces wherever they are present). Either way, the non-conductive material must be discontinuous to the extent that it allows the conductive materials to come into contact when the assembled mat is compressed. Thereafter, separate isolated electrical leads are attached to the inner faces of the mats so that they make contact with the conductive surface. The two conductive inner surfaces are oriented so that they face each other across the insulating layer and, if a separate central spacer is used, it is positioned between them. Finally, the apparatus is sealed at its edges to protect against invasion of moisture, typically through the use of an adhesive that is applied to the edges of the facing members.

However, mats assembled in this manner are subject to a variety of well-known problems. For example, if the non-conductive member is bent, it is possible to introduce breaks in the conductive ink pattern that has been printed thereon. If the break extends the width of the conductive surface, dead (i.e., nonresponsive) regions may be created in the mat or the mat may cease to function altogether.

Additionally, the seal between the two outer members is dependent on the quality of the adhesive bond between them. Depending on the choice of adhesive and the environmental conditions at the time the seal was formed—e.g., the relative humidity, temperature, etc.—the adhesion between the two outer members may be imperfect, which can allow moisture into the interior of the assembled device, thereby shortening its active and or shelf life.

Further, prior art mats are susceptible to cord pull out and may fail to open after being compressed, which failure is often because the air inside has been expelled and air pressure continues to hold the halves of the mat together after weight is removed.

Because of variability that is inherent in the current technology of printing conductive inks—which is typically done via some sort of screening process—the mats produced thereby can be unreliable and it can be difficult to create printed mats that exhibit specific electrical properties when the circuit is closed. Further, the screen process does not lend itself to repeatability, so it can be difficult, say, to produce a mat that has a particular resistance when closed.

Finally, and more generally, those of ordinary skill in the art will recognize that electronic equipment is subject to infiltration and attack by foreign gases, solids and liquids. Of course, the presence of such foreign compounds can damage or destroy sensitive electronic components. Externally operated switches are especially prone to contamination because they are usually located on the exterior of the device where they can be accessed by the user. As a consequence, membrane switches have become a staple in many settings because of their impermeability to most gases and chemicals and the ease with which they can be manufactured and marked.

However, conventional methods of manufacture of membrane switches require the creation of a mold or a hardened polished die which adds substantially to the cost of manufacture. Further, currently known methods of manufacture utilize a hydraulic or similar high pressure press to form the switches from the raw materials. Thus, what is needed is a method of manufacturing membrane switches which can be implemented using equipment made of softer metals (e.g., aluminum) which are cheaper to form. Of course, softer metals are only feasible if the pressure required to form the switches can be reduced, e.g. to presses utilizing pneumatic (rather than hydraulic) energy.

Heretofore, as is well known in the patient monitoring and switch arts, there has been a need for an invention to address and solve the above-described problems. Accordingly, it should now be recognized, as was recognized by the present inventor, that there exists, and has existed for some time, a very real need for a electronic patient monitor that would address and solve the above-described problems.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

SUMMARY OF THE INVENTION

In accordance with a preferred embodiment of the instant invention, an apparatus for patient monitoring is taught herein that is constructed via heat sealing according to the methods described hereinafter. The instant method and apparatus are designed to produce a patient monitoring switch that is more reliable and can be manufactured with less cost than has heretofore been available in the prior art.

More particularly and according to a first preferred aspect of the instant invention, there is provided a hermetically sealed binary switch that is constructed of a "sandwich" of alternating polyester and polyethylene layers. In the preferred embodiment, the mat consists of an upper member, a central spacer, and a lower member. The upper and lower members are both non-conductive on their outer surfaces and conductive on their inner surfaces, which inner surfaces face each other across the central spacer. The upper and lower members are both preferably composed of two elements: an outer nonconductive layer (preferably of a material such as polyester) and an inner nonconductive layer upon which has been deposited a conductor such as aluminum. The central spacer is also nonconductive and is preferably formed of a central core of polyester that has been placed between two layers of polyethylene. Additionally, the central spacer has at least one aperture passing therethrough, the purpose of the aperture being to allow the two conductive elements of the upper and lower members to come into contact when a weight is placed on the mat.

A critical aspect of this embodiment of the instant mat is that its perimeter is hermetically sealed against the atmosphere, thereby making it resistant to fluid invasion during use. Preferably, its interior will have been caused to contain rarified air during manufacture, which makes it possible to compress its two halves together in spite of the sealed perimeter. Alternatively, and in another preferred embodiment, the instant mat will be completely sealed along its perimeter, but a breathing tube will penetrate into the interior of the mat, thereby assisting the movement of air into and out of the mat during use.

According to another preferred mat embodiment, the upper and lower units are each composed of three elements: an outer nonconductive layer (preferably polyester), bonded to an inner adhesive layer (preferably polyethylene), and an inner conductive layer (preferably a layer of polyester upon which has been deposited a conductor such as aluminum). Preferably, the central spacer will be generally as described previously, with one or more apertures therethrough so that the conductive layers on the upper and lower members can come into contact when the mat is compressed.

Finally, there is provided hereinafter a method of manufacturing hermetically sealed binary switches which utilize heating to the glass transition temperature accompanied by a concomitant vacuum effect to create raised areas in the upper and, optionally also the lower surface, of a mat-like assembly. In more particular, according to the preferred embodiment a mat-like assembly that consists of alternating polyester and polyethylene members is placed in a heated press, wherein heat is preferably applied bi-directionally (e.g., from above and below). While the press is closed and the mat is being compressed and heated, a vacuum force is applied which tends to pull apart the heat-softened outer members of the mat, and draws those members into an incised, or otherwise formed, pattern of one or more depressions that have been formed in a special platen mold. These depressions or recessed region(s) are designed to become embossments or protrusions in the finished product, each of such embossments or protrusions yielding a membrane switch. The preferred final step is to rapidly cool the recently-formed mat to room temperature, thereby permanently setting the imprint of the platen into the surface of the mat.

Of critical importance for purposes of one preferred manufacturing embodiment is that the mat and/or membrane switches be formed by placing the various layers together into a packet and heat-sealing the unit along its periphery, preferably using heat that is simultaneously applied from both sides (i.e., from the directions of both the upper and lower member). It is a further preferred aspect that vacuum be used to pull apart the upper and lower laminar members of the mat during heat sealing, thereby creating pockets(s) or protuberance(s) in the outer surfaces of the mat and rarifying the air remaining therein.

The foregoing has outlined in broad terms the more important features of the invention disclosed herein so that the detailed description that follows may be more clearly understood, and so that the contribution of the instant inventors to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Further, the disclosure that follows is intended to be pertinent to all alternatives, modifications and equivalents as may be included within the spirit and scope of the invention as defined by the appended claims. Finally, it should be understood that the phraseology and terminology employed herein are for the purpose of description and should not be regarded as limiting, unless the specification specifically so limits the invention.

While the instant invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

BRIEF DESCRIPTION OF THE DRAWINGS

Other objects and advantages of the invention will become apparent upon reading the following detailed description and upon reference to the drawings in which.

DETAILED DESCRIPTION OF THE INVENTION

General Environment of the Invention

Figure 1:
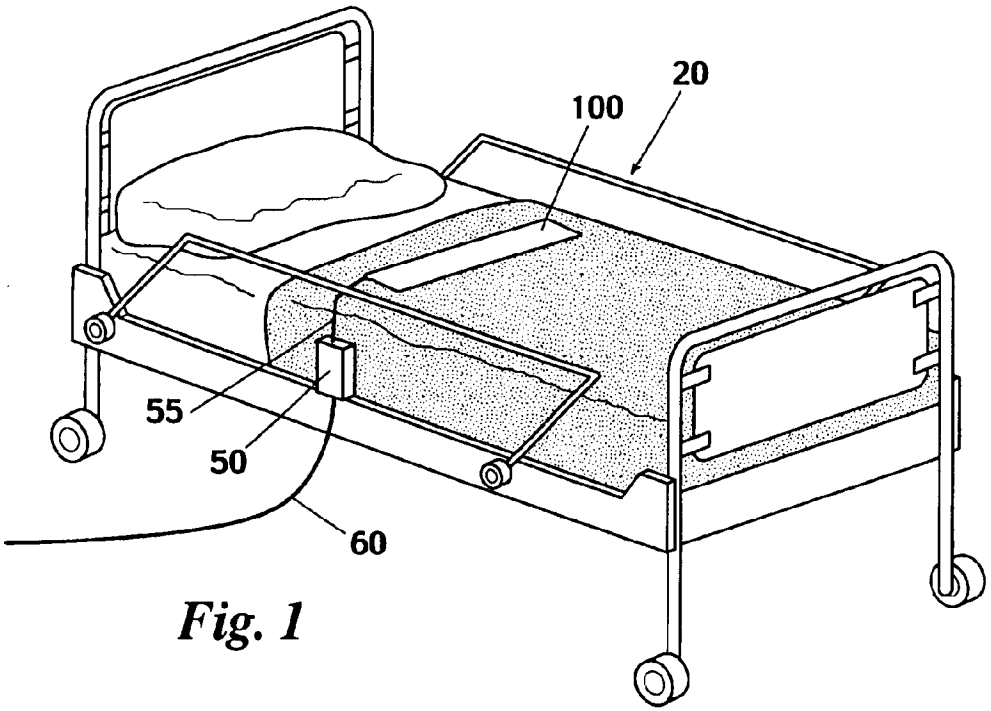
FIG. 1 illustrates generally how pressure sensitive mats are used on a hospital bed.

Turning first to FIG. 1 wherein the general environment of the instant invention is illustrated, in a typical arrangement a sensing mat 100 is placed on a hospital bed 20 where it will lie beneath a weight-bearing portion of the reclining patient's body, usually beneath the buttocks and/or shoulders.

Figure 2:
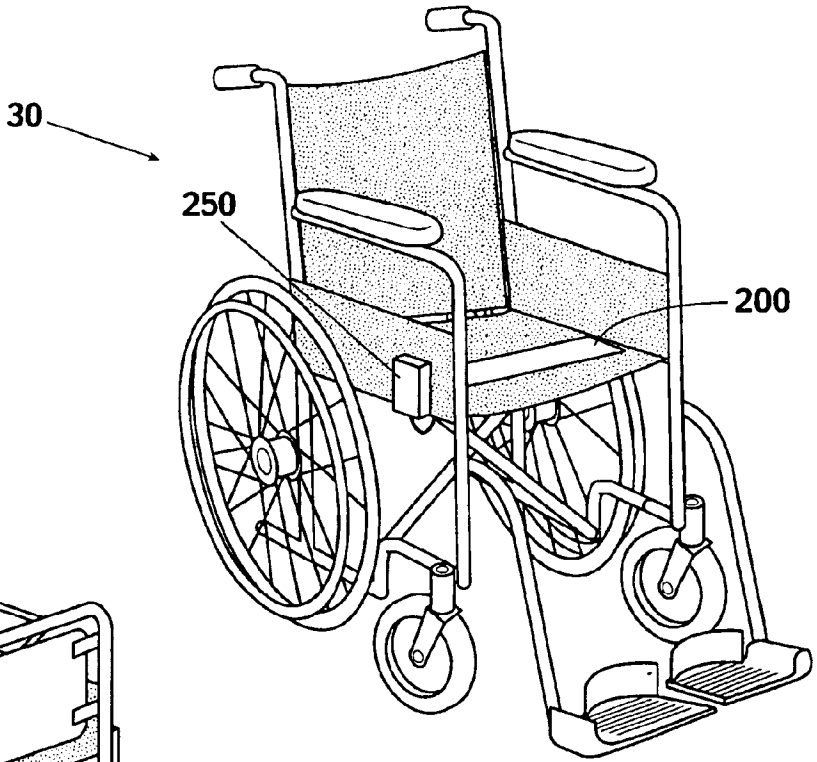
FIG. 2 illustrates generally how pressure sensitive mats are used on a wheelchair.

It should be noted at the outset, however, that although the language that follows is largely confined to illustrations involving bed-type sensors, the range of application of the instant invention is much broader and could include chair sensors, potty sensors, and any other type of pressure-sensitive switch that is used in a patient monitoring environment where invasion by fluids is a concern. Thus, when "bed mat" or "mat" are used herein, those terms should be construed as broadly as possible to include any or all of the foregoing applications. As a specific example, FIG. 2 illustrates how a chair mat 200/monitor 250 combination would normally be configured on a wheelchair 30. Preferably, the electronic monitor 250 for a wheelchair 30 will be battery powered to allow the occupant some freedom of movement while he or she is being monitored Generally speaking, the mat 100/monitor 50 combination works as follows. When a patient is placed atop the mat 100, the patient's weight compresses the mat 100 and closes an electrical circuit, which closure is sensed by the attached electronic patient monitor 50 through interconnecting line 55, which line 55 would typically be a conventional multi-element electrical line.

When the patient attempts to leave the bed, weight is removed from the sensing mat 100, thereby breaking the electrical circuit. The patient monitor 50 senses the change in electrical condition and signals the caregiver per its pre-programmed instructions, preferably through nurse-call connection 60. Note that additional electronic connections not pictured in this figure might include a monitor 50 to computer connection, and an A/C power cord for the monitor 50—although the monitor 50 can certainly be configured to be battery powered as is generally illustrated, for example, in FIG. 2.

Figures 3, 4, 13, 14:
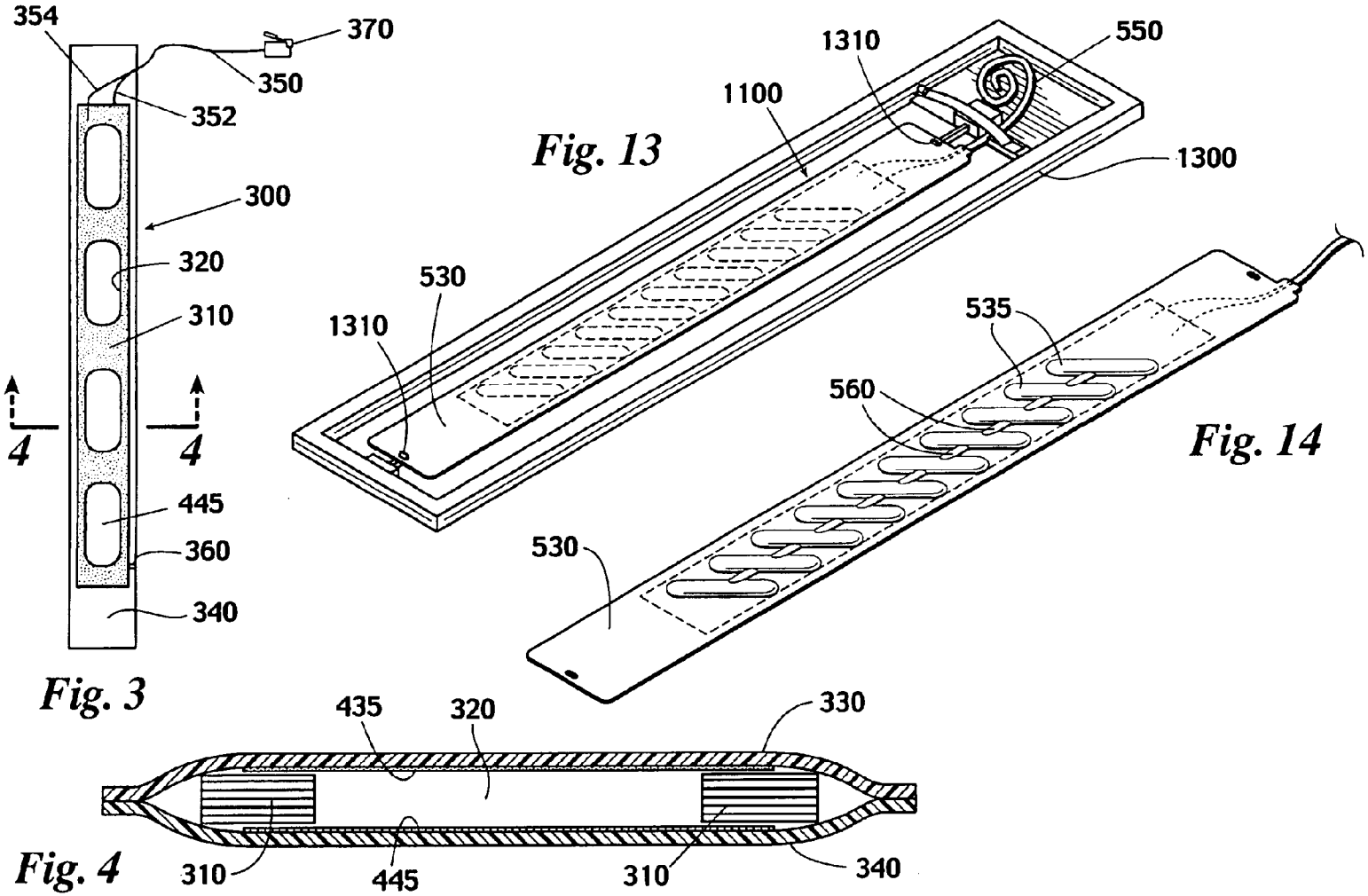
FIG. 3 is plan-view illustration of a typical prior art patient monitoring mat.
FIG. 4 is a cross-sectional view of a typical prior art patient monitoring mat.
FIG. 13 illustrates a preferred manufacturing arrangement, wherein a mat and cord are placed into a holder in preparation for sealing.
FIG. 14 contains a representation of a preferred mat embodiment after sealing.

FIGS. 3 and 4 contain schematic drawings of the interior of a prior art pressure sensitive patient mat. As is indicated in FIG. 4, a typical pressure sensitive mat 300 includes upper 330 and lower 340 non-conductive outer members, which serve to protect the interior of the mat from contact with the environment. These members are usually made of a flexible impermeable electrically non-conductive material such as plastic, with polyester being the preferred material. These two members 330 and 340 are conventionally separated by an internal compressible non-conductive spacer 310, which has at least one aperture therethrough 320. Note that in FIG. 3, the upper member 330 has been removed for purposes of illustration.

As is further indicated in FIG. 4, the typical pressure sensitive switch is a "sandwich" type arrangement with the two outer members surrounding the inner non-conductive spacer 310. The perimeters of the upper 330 and lower 340 members are conventionally sealed together by heat or by an adhesive (such as polyethylene). This seal has heretofore not been hermetic, though, as will be described in more detail hereinafter.

Affixed to the inner surface of each of the outer members 330 and 340 is a conductive layer (435 and 445, respectively) which, for safety purposes, preferably does not extend to the edges of the mat 300. As should be clear, pressure on the mat 100 tends to urge the conductive faces 435 and 445 into contact through aperture 320, thereby completing an electrical circuit. When the compressive pressure is released, the central spacer 310—which is constructed of a compressible and resilient material such as closed cell foam rubber—expands and pushes the conductive layers apart. The central spacer 310 is assisted in that effort by the elastic nature of the outer layers 330 and 340.

As is suggested in FIG. 3, when the electrical line 350 enters the mat it is typically separated into two electrically isolated elements 352 and 354, one of which is placed in electrical communication with the conductive layer 435 atop of the spacer 310 and the other which is placed in electrical communication with the conductive layer 445 that is beneath the spacer 310 in FIG. 4. Connector 370 at the terminus of electrical line 350 is for connection with an electronic patient monitor of the type discussed previously.

As is generally illustrated in FIG. 4, the central spacer 310 usually fits loosely within an envelope formed by the two outer layers 330 and 340. This arrangement allows air to move freely throughout the interior of the mat 300. Fluid (e.g., pneumatic) communication between the interior of the mat and the atmosphere is typically provided in the form of one or more breaches in the seal between the upper 330 and lower 340 members. These breaches are typically created during the manufacturing process and provide a means for the mat 300 to "breathe" when compressed. A first natural breach occurs at the point where electrical line 350 enters the mat between the upper 330 and lower 340 mat members. Typically, the mat material fits loosely around the electrical line 350, thereby providing a ready passageway for air (and fluids) to enter and exit the mat. Where more airways are needed, it is possible to create gaps between the outer members along their common perimeter. One way of doing this involves placing a piece of monofilament line between the upper 330 and lower 340 members before they are sealed. After the two members have been sealed together, the line is withdrawn, leaving behind a small gap 360 in the seal between the layers.

Preferred Mat Embodiments

Turning now to FIGS. 5 through 11, wherein a preferred mat embodiment of the instant invention is illustrated, there is provided a pressure-activated binary switch 500 for use in patient monitoring that has an interior which is completely sealed along its periphery against the external environment. As is described hereinafter it is preferable that the instant invention be hermetically sealed along its perimeter, but at minimum it should be sealed along its periphery to the point of excluding fluids.

Figure 8:
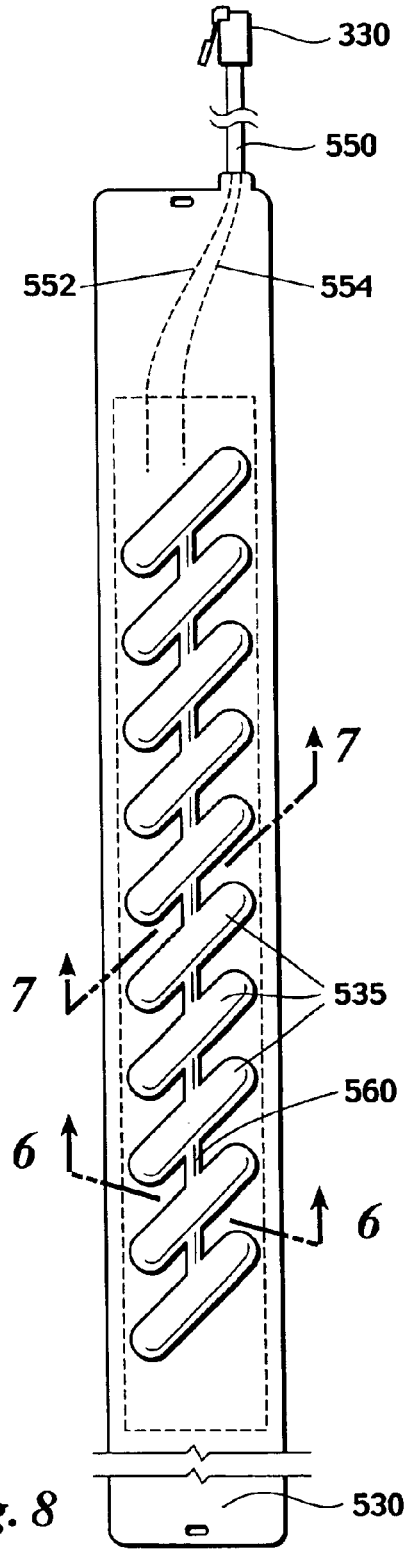
Figure 6:
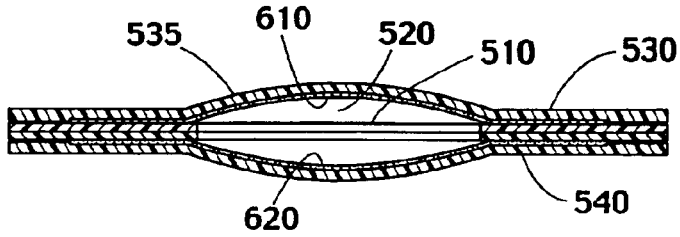
FIG. 6 is a cross-sectional view of the embodiment of FIG. 8 taken across a protuberance.
Figure 7:
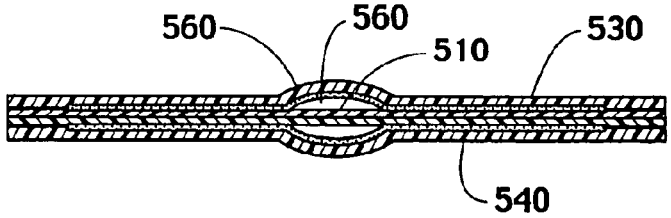
FIG. 7 is a cross-sectional view of the embodiment of FIG. 8 taken across an air channel; and, FIG. 8 is a top plan-view of a preferred mat embodiment.

As can be seen most clearly in FIG. 8, the instant preferred embodiment 500 is generally rectangular in shape, with electrical lead 550 and connector 530 (which might typically be a telephone-type RJ-11 connector) provided for attachment to an electronic monitor 50 of the sort discussed previously. On the upper surface 530 (and, preferably, also on the lower surface 540) are raised a series of protuberances 535, interconnected by raised air channel 560, all of which structures are formed in the outer members by a method to be discussed hereinafter. For purposes of the instant disclosure, the term protuberance will be used in its broadest sense to include bubbles, pockets, pillows, domes, protrusions, extrusions, etc., wherein a portion of the material of the mat is raised with respect to the body of the mat, which is preferably a substantially planar surface aside from the protuberances 535. Additionally, although the preferred mat 500 is rectangular in shape, it should be noted that the shape of the mat 500 is irrelevant to the practice of the instant invention and that any mat geometry (e.g., round, curved, oval, octagonal, triangular, etc.) might prove to be useful in a particular setting.

Figure 5:
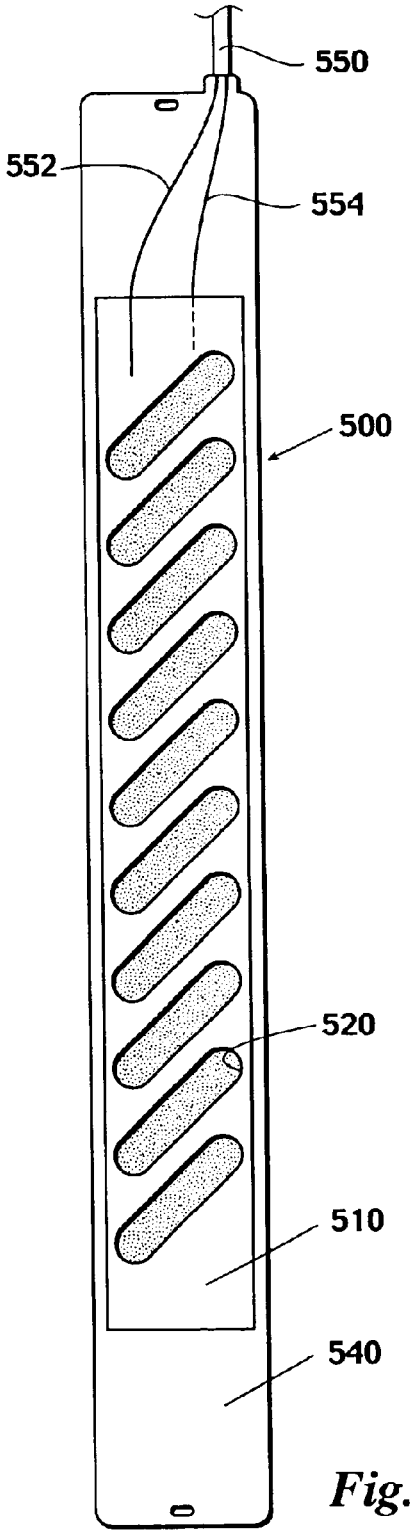
FIG. 5 contains a plan-view illustration of a preferred mat embodiment with the upper non-conducting layer removed.

FIG. 5 contains a plan view of the embodiment of FIG. 8 with the top member 530 removed. Additionally, FIG. 11 contains an exploded view of the same embodiment. As can be generally observed, the instant preferred mat invention 500 broadly consists of three members, each of which will be described at greater length hereinafter: an upper member 530 (FIG. 8), a lower member 540 and a central spacer 510. As can be seen more clearly in this figure, electrical lead 550 preferably bifurcates into two electrically isolated conductors 552 and 554. In this figure, lead 552 is shown to be atop of the central spacer 510 and would normally be in electrical communication with the electrically conductive material 610 (FIG. 6) that is associated with the inner face of upper member 530. Similarly, lead 554 would be in electrical communication with the conductive layer 620 that is found adjacent to the inner face of lower member 540.

The central spacer 510 has at least one aperture 520 cut therethrough, which aperture is designed to allow the conductive inner faces 610 and 620 of the upper 530 and lower 540 members, respectively, to come into contact when the mat 500 is compressed by the weight of a patient. Additionally, the instant embodiment will preferably have protuberances 535 created in the outer faces therefore that are symmetrically positioned on either side of an aperture 520 of about the same size, orientation, and location (e.g., FIG. 6). That being said, it should be noted that it is not an absolute requirement that the protuberances 535 and the apertures 520 be of about the same size, orientation, and location. In fact, it is only necessary that the size and locations of the apertures 520 be such that they allow the two conductive inner faces 610 and 620 to meet when the mat is compressed: there is no requirement that the respective sizes must be the same or even similar. That being said, for purposes of specificity in the instant disclosure, it will be assumed that the protuberances 535 and apertures 520 are comparable in size and orientation. Those of ordinary skill in the art will readily appreciate how the respective sizes and orientations can be varied without changing the functionality of the invention taught herein.

It can be seen that a central purpose of the protuberances 535 is to provide additional separation between the respective conductive surfaces 610 and 620 when there is no weight on the mat 500, as the conductive surfaces 610 and 620 are formed into and become a part of the concave side of the protuberances 535. This obviously then moves further apart the conductive surfaces 610 and 620 when the mat is uncompressed. However, upon the application of a patient's weight, one or more of the protuberances 535 will collapse and bring together the conductive surfaces 610 and 620 through at least one aperture in the spacer 510, thereby completing an electrical circuit which can be sensed through electrical connector 550 by electronic monitor 50.

Figure 9:
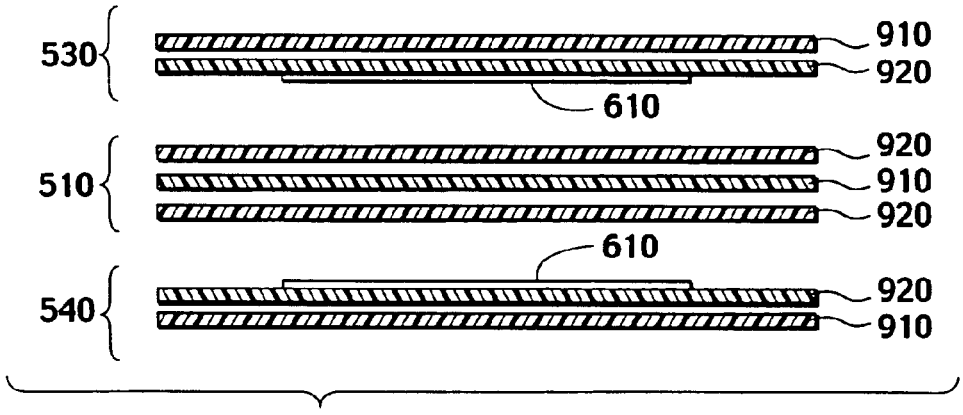
FIG. 9 is a cross sectional view of a preferred mat embodiment that illustrates a preferred layer arrangement.

Turning now to FIG. 9 which contains additional details of the preferred mat construction, note that upper and lower members 530 and 540 are both preferably a composite of two different layers 910 and 920 (which are preferably heat-bonded together), and the central spacer 510 is preferably composed of three layers of the same materials. Although any number of materials might be employed in building the instant mat, polyester is the material of choice for element 910 and polyethylene the choice for element 920. However, whatever materials are used, it is an essential requirement that the materials that are utilized in this mat be at least malleable enough when heated to have protuberances formed in them as is described below. Additionally, any mat 500 constructed from these materials must be capable of being completely sealed around its periphery. Finally, because of the difficulty of bonding polyester-to-polyester, the preferred arrangement—involving, as it does, alternating layers of polyester and polyethylene—is especially suitable, as the alternating layers of polyethylene act as a bonding/adhesive agent which can adhere both to polyester and to the other polyethylene layers, thereby sealing the multi-layered mat 500 together.

As is generally indicated in the cross section of FIG. 9, in the preferred embodiment the upper member 530 of the preferred mat 500 consists of two components: a layer of polyester 910 together with a layer of polyethylene 920 upon which has been deposited a thin layer of a conductor 610 such as aluminum. That being said, many variations of the thickness of the polyester 910, polyethylene 920, and the amount of conductive material 610 deposited have been considered and those of ordinary skill in the art will be able to devise many alternatives that would be suitable for use with the instant invention. Further, although vacuum deposition is the preferred method of making the polyethylene layer 920 conductive on its inner face, there are many alternative methods that could be used including, without limitation, sputtering, deposition, flame spray, ion plating deposition, vaporization, plasma polymerization, laminating a conductive structure on the face of the polyethylene, spraying, dipping, flow coating, powder coating, etc., all of which application methods are within the spirit of the instant invention.

Additionally, as was mentioned previously, for purposes of patient safety it is preferable that the conductive layer 610 does not extend to the edge of the mat where it could come into contact with a patient. In a typical situation, though, the conductive surface will have been pre-applied by a materials provider and it would extend to the edges of polyethylene layer 920, contrary to the configuration of the preferred embodiment. In such a case, it is well within the skill of one of ordinary skill in the art to remove the conductive material near the periphery of the polyethylene layer 920 by, for example, abrasion or other means.

Finally, although aluminum is the preferred conductive material, those skilled in the art will recognize that any number of conductive materials might be utilized instead depending on the particular needs of the situation and the goals of the user. For example, conductive materials such as silver, copper, gold, platinum, stainless steel, and any sort of carbon-based, polymer-based, or metal-based ink, would be suitable for use with the instant invention. In the preferred embodiment, the conductive layer 610 will have a thickness of about 1–15 mils.

Lower member 540 is preferably constructed of the same materials as upper member 530, i.e., a combination of a polyester layer 910 and a polyethylene 920, with the polyethylene being treated so as to be conductive at least on its inner face. The aluminum/conductive layer 610 is preferably formed as described previously.

Central non-conductive spacer 510 is preferably made of polyester 910 which has been positioned between two layers of polyethylene 920. This combination is non-conductive as required and particularly suitable for manufacture as is described previously In operation, the instant hermetically sealed mat 500 functions as follows. The mat 500 is placed on a bed, seat, etc., where a patient is to be rested. When the patient places his or her weight on the mat, the two conductive surfaces 435 and 445 are urged into contact with each other through the apertures 320 in central spacer 310 when the protuberances 535 collapse. This process is made more reliable by way of the inclusion of air channel 560 (see, e.g., FIG. 6), which permits free movement of air from regions in the mat 500 which are compressed to other portions of it which do not bear as much of the patient's weight. This helps prevent an "air pillow" effect which might make it more difficult to force the two conductive surfaces into contact. That is, if air were separately trapped within each pocket or "bubble" in the mat 500, the trapped/compressed air would provide support for the patient's weight, possibly to the point of preventing contact between the opposing conductive sides. However, by providing fluid/pneumatic communication between the protuberances 535 and, preferably, by additionally rarifying the air trapped in the protuberances 535 and air channel 560 as described hereinafter, the instant invention can be reliably compressed and contact established between the conductive surfaces. Additionally, this same communication pathway helps reduce the opposite problem, i.e., a failure to reinflate after compression.

Further, the instant inventors have discovered that by varying the size, location, etc., of the protuberances 535 mats that respond to different compressive forces can be produced. For example, the instant inventors have determined that when the protuberances 535 that have been formed in the mat are made larger, the weight needed to trigger the switch is reduced. Similarly, when the protuberances 535 are made smaller in width or length the weight needed to force the conductive surfaces into contact is similarly increased. Of course, in either case it is assumed that apertures 320 are appropriately resized and repositioned as necessary to make the resulting mat 500 operational.

Further, changing the thickness of the materials that make up the upper and lower units 530 and 540 will similarly change the responsiveness of the instant switch 500 to pressure, although the amount of change may not be linear. For example, if the materials are made thicker, the resulting mat would be less responsive to weight placed thereon. Obviously, the opposite would be true if the thickness of the materials were reduced. It should be noted, however, that the shape of the protuberances 535 is intended to reduce the effect of increased thickness on the central spacer 510.

Still further, it should be noted that the term "hermetically sealed" should be interpreted in its broadest sense to include any complete sealing of the perimeter of the instant device to the point of excluding fluid. That need not mean that the interior of the mat is completely isolated from the atmosphere. For example, the instant inventors have specifically contemplated that a breathing tube of the sort taught in U.S. Letters Pat. No. 6,417,777, for "Pressure Sensitive Mat with Breathing Tube Apparatus," the disclosure of which is incorporated herein by reference, might be made a part of the instant invention. That is, it is contemplated that a breathing tube might be inserted between the mat layers and completely sealed therein. The breathing tube would then provide a passage for air between the interior of the mat and the atmosphere, thereby ensuring that the mat can be compressed and expanded without problems caused by pressure differentials between the interior of the mat and the atmosphere. Of course, it would be important that the mat be completely sealed around the breathing tube where it enters the mat.

Figure 22:
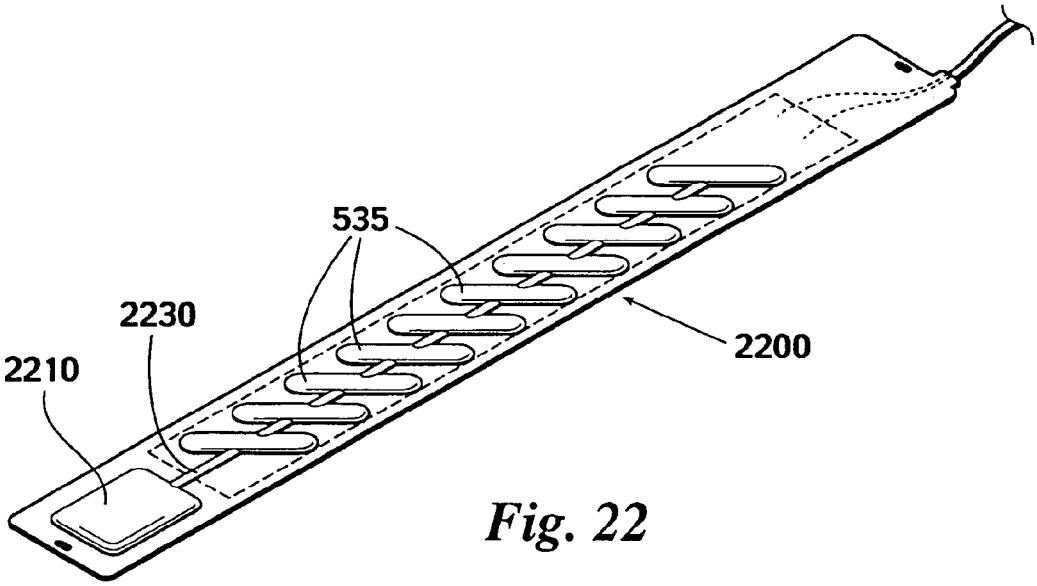
FIG. 22 contains an illustration of another preferred mat embodiment which contains an auxiliary air pocket.
Figure 23:
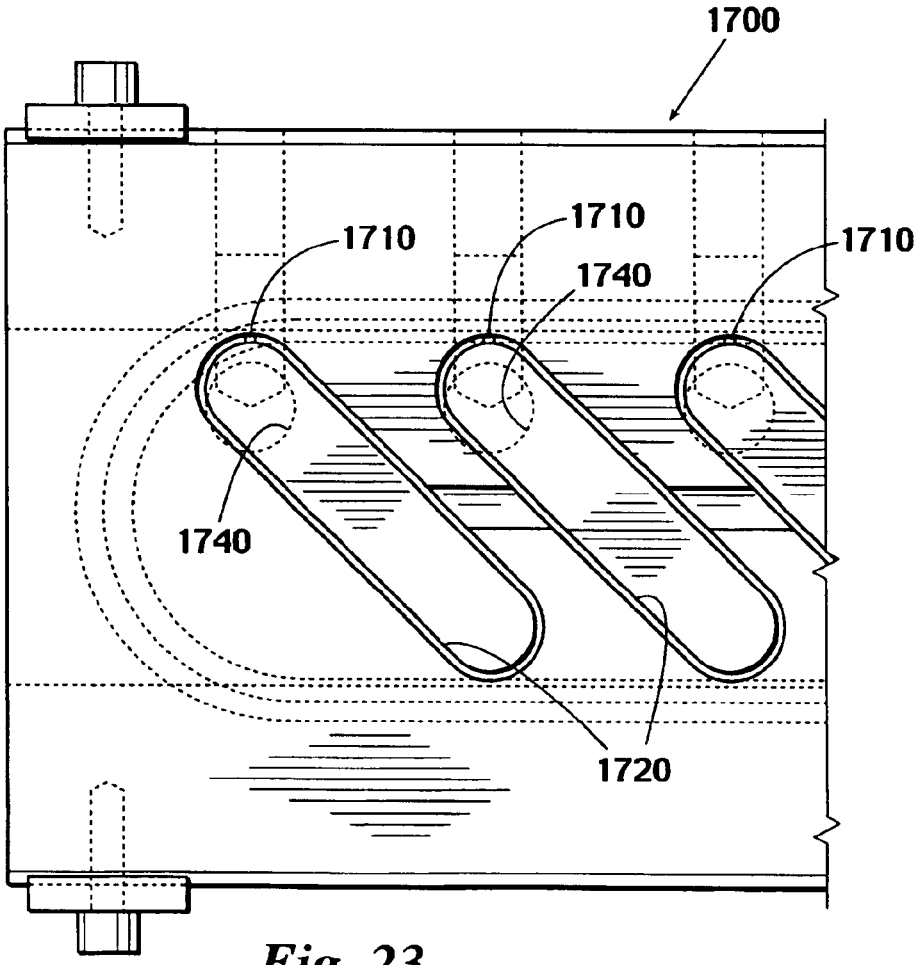
FIG. 23 contains a detailed view of the platen embodiment of FIG. 17.

Finally, as is generally indicated in FIG. 22, there is provided another mat embodiment 2200 which utilizes an auxiliary air reservoir 2210 which has been located at one end of the mat. Air reservoir 2210 is preferably an enlarged air pocket which is interconnected with the system of protuberances 535 by air channel 2230. The purpose of the air reservoir 2210 is to provide an additional volume into which air that is trapped within the mat can move when the mat is compressed, thereby making it easier for the conductive surfaces that are located on the insides of the protuberances 535 to move into contact. In the preferred embodiment, the air reservoir 2210 will not contain conductive material on its inner surfaces, as would normally be found within protuberances 535. This is because the air reservoir 2210 is intended only to accept air that has been expelled from the protuberances 535 and would not normally be used to detect the presence or absence of a patient. Alternatively, the air reservoir 2210 could be made to be electrically conductive on its inner surface (or, more likely, left as electrically conductive after the rest of the surface had been prepared), provided that the central spacer 310 were arranged so as to keep the electrically conductive portions apart when the air reservoir 2210 is compressed. That being said, it should be clear that the air reservoir 2210 could be utilized as an active part of the instant switch 2200 by extending the conductive material 610 the full length of the mat 2200, but the fact that the air reservoir 2210 will typically be different in size from the protuberances 535 means that it will likely have a different sensitivity/threshold activation level from the preferably identically configured protuberances 535, which would generally not be desired.

Those skilled in the art will recognize that the instant air reservoir 2210 of FIG. 22 could easily be positioned at either end of mat 2200. It could also be positioned near the middle of the mat, although that would normally not be desired. Further, the instant inventors contemplate that multiple air reservoirs 2210 could also be used in a single mat, e.g., one might be positioned at each end of the mat 2200. Further, it is preferable that air reservoir 2210, which is illustrated as being on the upper surface of mat 2200, have a symmetrically positioned and sized counterpart air reservoir on the underside of the mat 2200. Of course, that is just the preferred arrangement and it is not essential to the operation of the instant invention.

Preferred Membrane Switch Embodiments

According to another variation of the above-described invention, there is provided an embodiment substantially as described above, but wherein the protuberances are customized to take the form of membrane switches which are separately useful in patient monitoring, as well as in other applications and fields.

Figure 24:
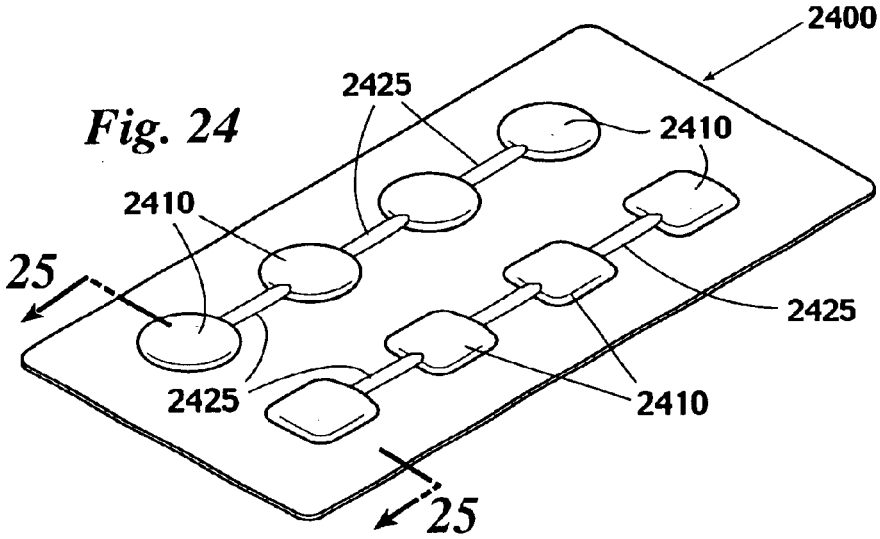
FIG. 24 contains an illustration of a preferred switch embodiment wherein a plurality of switches are formed in a single cycle of the press.

Turning first to FIG. 24, as can be seen in the preferred arrangement 2400 multiple membrane switches 2410 will be made during each cycle of the press 1500. As has been described previously, in the preferred embodiment the instant membrane switch invention will be formed from multiple/alternating layers of polyester and polyethylene, the polyethylene generally acting to bind together the polyester layers (e.g., FIG. 25). In the preferred arrangement, the mold that is used to form the switches 2410 will be designed so as to create air passages 2425 therebetween, so that the interiors of all of the switches 2410 will preferably be in fluid contact with the atmosphere at the time they are formed. Additionally, it should be noted that although the air passages 2425 displayed FIG. 24 are shown in a parallel linear configuration, that is not essential. Indeed, in some instances it is preferred that the pattern formed by the air passages perform a useful function, such as acting to interconnect specific switches, thereby guiding a user through a suggested sequence of button presses, wherein the buttons are pressed in the order indicated by the order in which successive buttons are interconnected by the air passageway. For example, when a block of membrane switches is formed for a particular application (e.g., for use as the control panel of a microwave oven), the air passage might start at the first switch that is to be pressed (e.g., "clear") and then link each switch that is to be pressed in sequence thereafter (e.g., "power level", "time", and "start"), so that a user could simply follow the pattern of the air passage within the switch block to determine the order of activation. Of course, in some switch banks it might be necessary to have multiple paths interconnecting the switches and, hence, multiple (and possibly intersecting) air passages would be used. Those of ordinary skill in the art will recognize that many alternative arrangements are possible. Finally, and as is generally indicated in FIG. 24, the switches 2410 might be manufactured to be generally circular, rectangular, or any other arbitrary shape depending on the needs of the designer and the configuration of the platen molds that form them.

Figure 25:
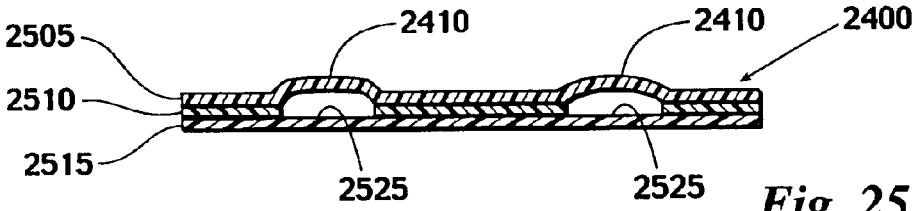
FIG. 25 illustrates a cross section view of the embodiment of FIG. 24.

FIG. 25 contains an illustration of the embodiment of FIG. 24 in cross section and makes clearer the layered nature of the preferred arrangement. More particularly, it is preferred that the membrane switch 2410 be constructed of alternating layers of polyester (2505 and 2515) and polyethylene (2510), with apertures 2525 being cut in the polyethylene layer 2410 to allow the upper 2405 and lower 2415 polyester layers to come into contact therethrough when pressure is applied to each switch 2410.

Figure 26:
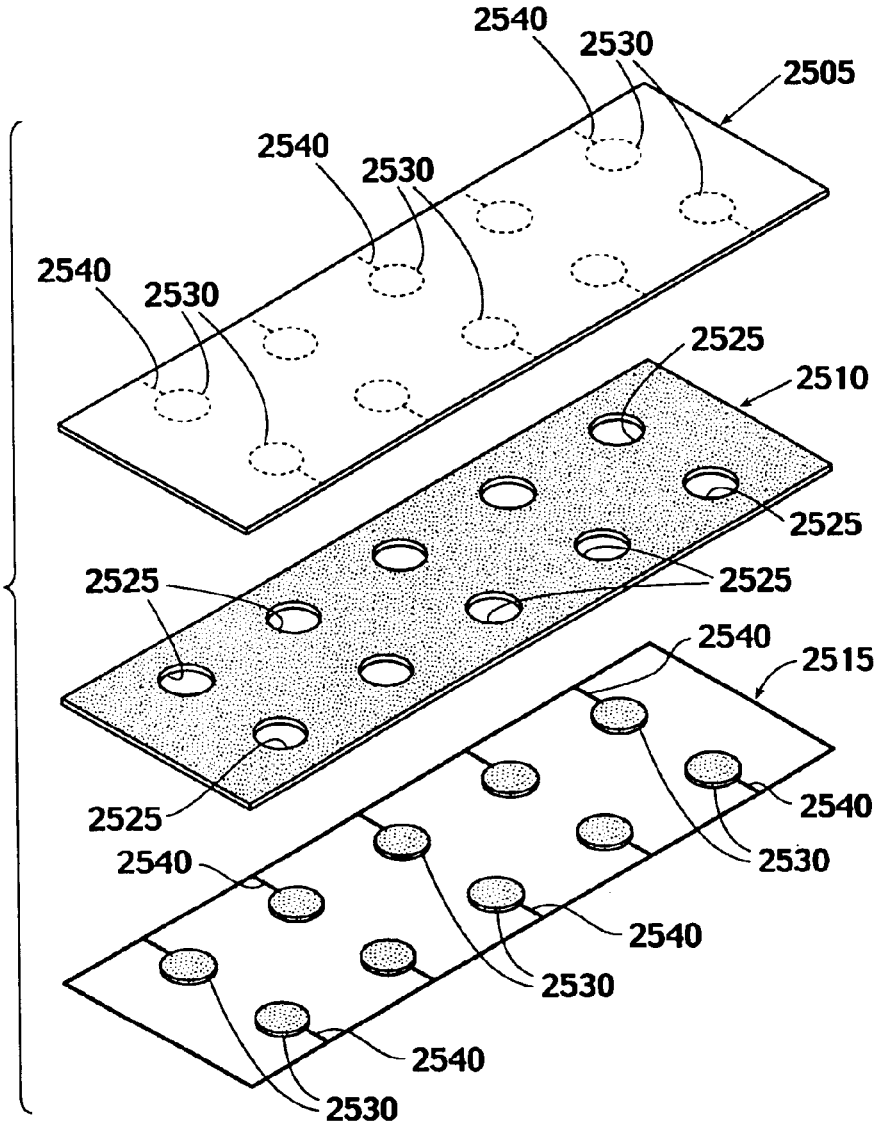
FIG. 26 illustrates a preferred mat embodiment wherein the mat is comprised of there layers of material.

As is further illustrated in FIG. 26, it is preferred that electrically conductive regions 2530 be positioned on the lower member 2415 in locations corresponding to placement of the apertures 2525. Preferably, each such conducting region 2530 will be in electrical communication with a conductive element 2540 which is an electrical lead that is accessible by an external device. Additionally and preferably, the underside of top member 2405 will be similarly be equipped with a corresponding number of conducting regions and attached conductive elements that are positioned to match those on the lower member 2415 and to come into contact with same when some portion of the upper unit 2405 is compressed through the appropriate aperture 2525. Of course, those of ordinary skill in the art will recognize that by monitoring the electrical resistance or some other property between the electrical leads attached to the conductive regions on opposite sides of the central spacer 2410 it is possible to tell whether the corresponding membrane switch 2410 has been depressed.

Figure 28A:
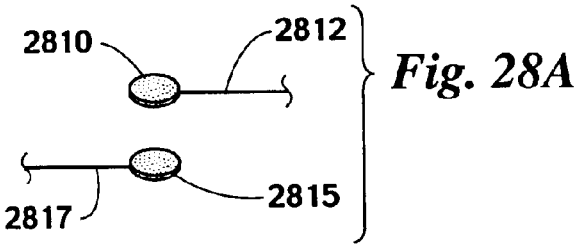
FIG. 28 illustrates some preferred membrane switch embodiments.
Figure 28C:
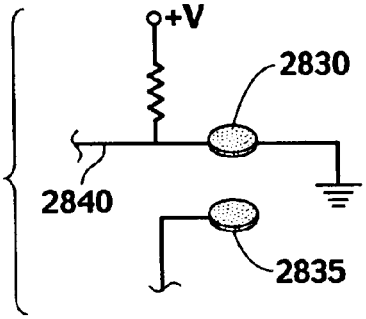
Figure 28B:
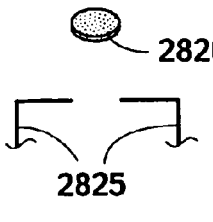

FIGS. 28A–28C illustrate some preferred configurations of the interior of a membrane switch 2410. According to FIG. 28A, a conductive region 2810 will be positioned on the upper member 2505 and a corresponding conductive region 2815 on the lower member 2515, so that by measuring the electrical conductivity (or resistively) across leads 2812 and 2817 a switch closure can be sensed. In another arrangement, a conductive region 2820 will be positioned on the underside of upper member 2505 and an open circuit 2825 will be imprinted on the upper side of lower member 2515, so that when the switch is compressed, the conductive region 2820 will come into contact with and close the circuit 2825, thereby making it possible to tell whether or not the switch 2410 is compressed. Finally, and according to still another preferred arrangement, the contact regions 2830 and 2835 will be configured so that when they come into contact, line 2840 will be pulled low. In one preferred arrangement, the status of line 2840 will be sensed via a microprocessor data or similar input port.

Note that the foregoing are just a few of the many possible configurations that could be employed in constructing the instant membrane switch and those of ordinary skill in the art will be readily able to devise others.

Preferred Apparatus and Method of Mat Manufacture

Turning now to the method of manufacturing the preferred binary switch, the instant inventors have discovered that polyester, and especially oriented polyester, is in some ways nearly an ideal material for use as a mat exterior. It is impervious to fluids, non-conductive, relatively inexpensive, and flexible, all of which are important mat properties. Additionally, it is malleable and can be plastically deformed under heat to yield the protuberances 535 and air channels 580 of the sort described previously. However, for all of its useful properties, using polyester in mat construction is somewhat problematic, as it can be difficult to reliably bind together the two outer layers of the mat.

As is well known to those skilled in the art, polyester-to-polyester bonds are notoriously subject to dissolution in the field. Pressure sensitive adhesives, which represent one conventional approach to binding the mat-components together, certainly work well in a pristine laboratory environment but run into limitations when put to work in the field. By way of example, it might be expected that in a hospital environment after a mat is placed into service it will be exposed to a variety of cleaning/disinfecting solutions. However, some of the cleansers to which the mat will be exposed are well known solvents that can be expected to rapidly dissolve conventional adhesive bonds between the mat members. This, of course, will shorten or terminate the useful life of the mat by allowing its interior to be prematurely invaded by (usually electrolytic) fluid, thereby short circuiting its internal switch and exposing the patient to the electrical current that is used to test the switch's closure. Thus, the instant inventors prefer that the mat layers be hermetically joined together via a heating process as is described below.

Although heat sealing is the preferred method of hermetically sealing the mat layers together, those skilled in the art will recognize that heat sealing is not really an option for creating a polyester-to-polyester bond. Because polyester is typically work hardened at the time of its manufacture, any attempt to melt or partially melt it will destroy that structure and render the resulting mat too distorted to be useful.

However, the preferred polyethylene/polyester sandwich suggested above avoids this problem. Since the melting point of polyethylene is below that of polyester, when alternating layers of the two substances are heated to an appropriate temperature the polyethylene melts and bonds the stack together without harming the polyester layers.

Figure 10:
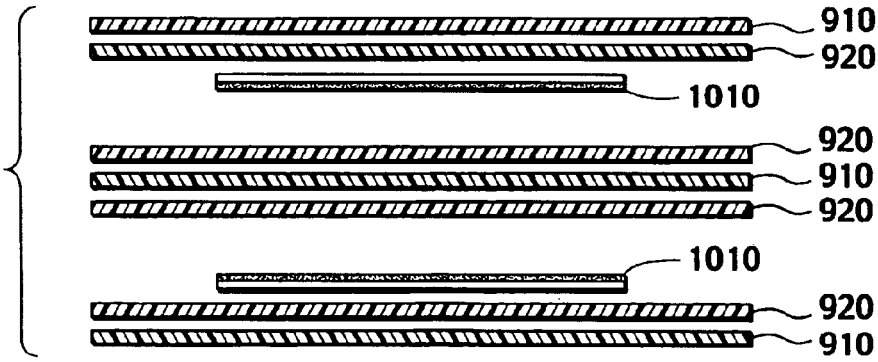
FIG. 10 is a cross sectional view of another preferred mat embodiment that illustrates a different preferred layer arrangement.
Figure 11:
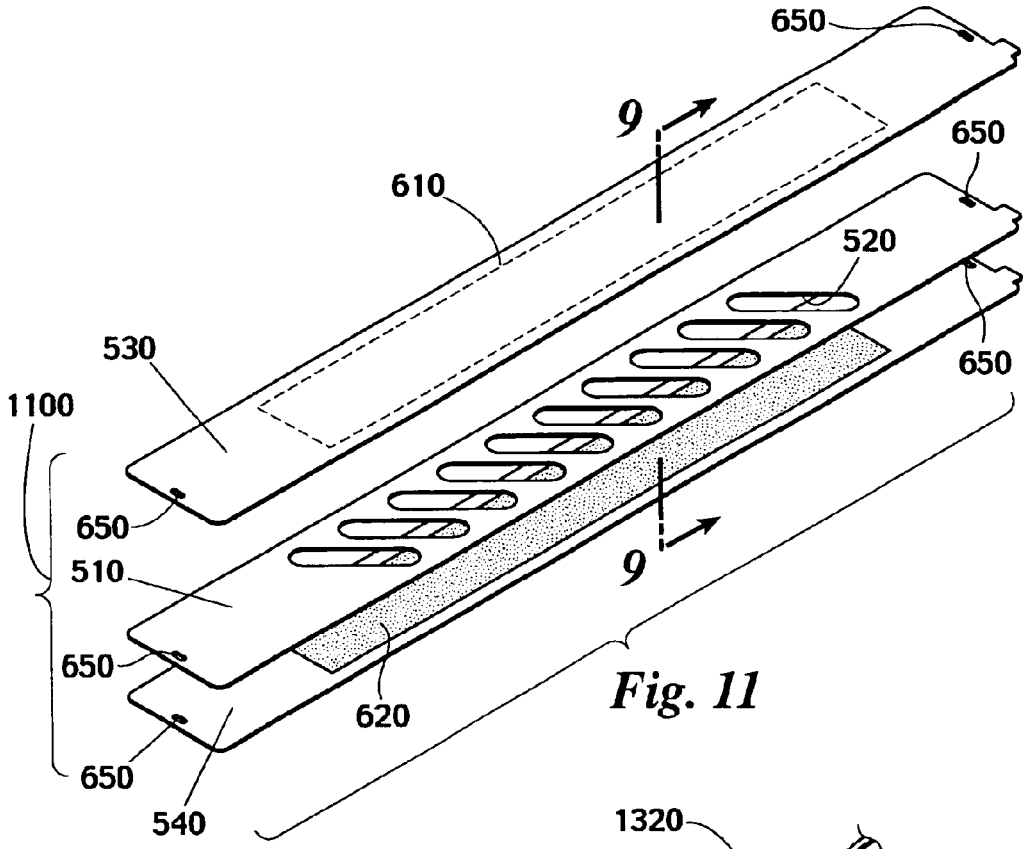
FIG. 11 illustrates how the layers of a preferred embodiment of the instant mat are assembled for sealing.
Figure 12:
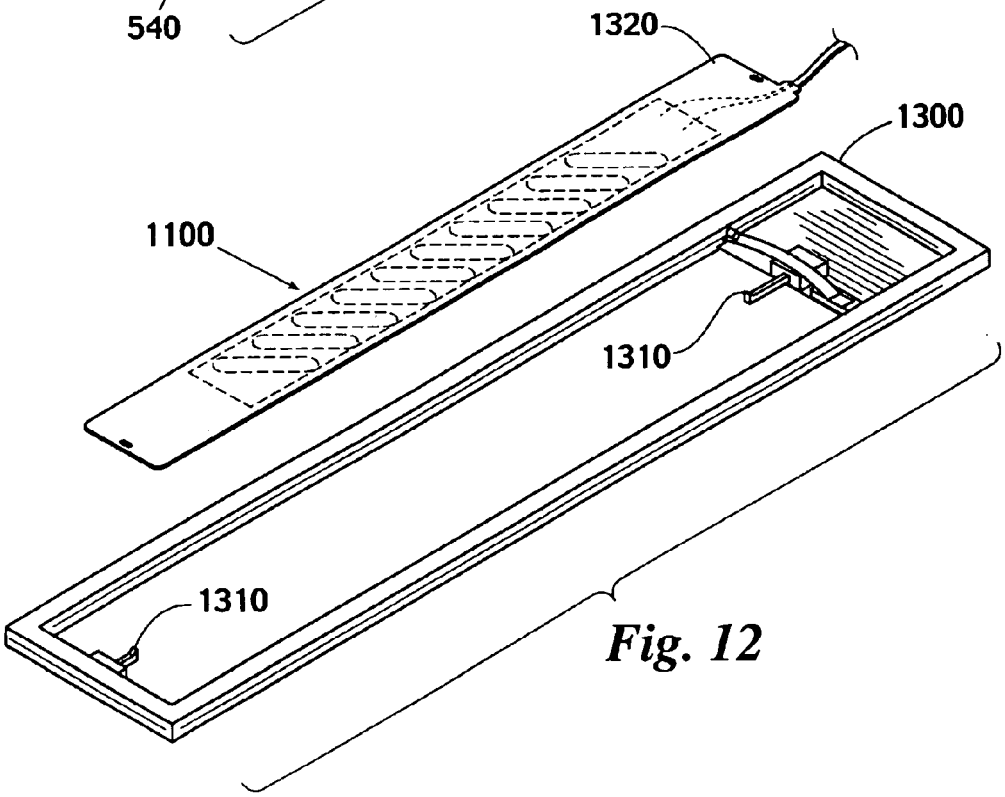
FIG. 12 contains an illustration of a preferred aligning tray that would be suitable for use in assembling a preferred mat embodiment.

Thus, in the preferred embodiment a combination of polyester and polyethylene will be used to form the instant mat: the arrangement of FIG. 9 indicates one preferred arrangement, FIG. 10 illustrates another. In FIG. 10, the configuration includes separate conductive layer 1010 which is preferably aluminized polyester. It would typically be inserted between the outer members 530/540 and the central spacer 510 before heat sealing.

Turning now to FIGS. 12 through 16 wherein a preferred apparatus suitable for the instant manufacturing process is broadly illustrated, according to the instant invention there is provided a method of manufacturing a pressure-sensitive binary switch for patient monitoring, wherein the binary switch is hermetically sealed during its manufacture and which manufacturing process preferably introduces a plurality of protrusions into the mat.

As a first preferred step, pieces of polyester and polyethylene are cut to the appropriate size for later assembly. The polyester and polyethylene will typically be obtained in rolls that are several hundred feet in length and have a thickness which would usually be somewhere between about 1 and 15 thousandths of an inch, depending on the mat properties that are desired by the creator. Additionally, it is possible and, indeed, preferred to acquire polyester to which has already been adhered the polyethylene layer upon which has been deposited the electrical conductor. Thus, in the preferred embodiment the upper and lower outer members 530 and 540 will be provided pre-assembled.

Further, in the preferred embodiment, the conductive material will be a conductor such as aluminum that has been deposited on the polyethylene to a thickness sufficient to conduct electrical current, i.e., preferably aluminized polyester will be used. That being said, for purposes of specificity herein the instant invention will be discussed in terms of the use of aluminized polyester as the conductive layer, although those skilled in the art will recognize that many other materials could be utilized in the alternative including, e.g., conductive ink.

Next, preferably upper 530 and lower 540 members are cut from the continuous roll according to methods well known to those skilled in the art. In the preferred embodiment, a custom die will be used to cut these members to length from the roll on which the raw material would be typically provided and to create additional apertures and extensions that are useful during assembly.

As a next preferred step, about one-half inch the conductive material will be removed from each of the edges of the aluminized polyethylene layer. Although it is possible to obtain conductor-coated polyethylene which has not been fully covered out to its edges, in general the instant inventors have determined that it is preferable to order it fully coated and then remove as much conductor as is deemed necessary from its edges. As is well known to those of ordinary skill in the art, if the electrical conductor reaches to the edge of the mat, the patient could be at risk of galvanic burns from the electrical current that is used to monitor the status of the mat. Thus, it is generally advisable to strip the conductor by, for example, utilizing abrasive action on the periphery of the aluminized polyester material to remove the aluminum coating.

Central spacer 510 is preferably cut via a die that also creates apertures 520 therein. In the preferred embodiment, the apertures 520 in the central spacer 510 will be matched to the shape and orientation of the protuberances 535, although, as discussed later, this is not strictly required. Additionally, both this member 510 and the outer members 530 and 540 preferably include mounting holes 650 at each end, the function of which is discussed in detail below.

As is illustrated in FIG. 13, the components 1100 of the mat (see FIG. 11) are next stacked and placed within assembly frame 1300. As should be clear from FIGS. 12 and 13, the purpose of the assembly tray 1300 is to align the separate mat pieces and prepare the unit for sealing. Hooks 1310 are designed to mate with mounting holes 650 and help to assure that the package is in alignment at the next step. Of course, part of the assembly process includes insertion and placement the electrical lead 550. FIG. 13 illustrates how the electrical lead 550 is preferably treated during assembly.

Once the individual components have been assembled, the mat is ready to be sealed. FIGS. 14 through 21 illustrate a preferred apparatus 1500 that is suitable for performing the sealing of the mat and the creation of protuberances 535. In brief, the preferred manufacturing apparatus is as follows. The assembly tray 1300 containing the components of the mat is placed into a press 1520 which preferably simultaneously heats, compresses, and applies a vacuum to the mat, each of which conditions is separately discussed below. The heating/compression fuses the separate components of mat together, while the vacuum creates the protuberances 535 in the mat outer surfaces while the mat materials are softened by heating. After the mat has been heat sealed and formed, the assembly tray 1300 is moved to a cooling press 1530, which compresses and cools it. Thereafter, the mat is removed and made ready for shipment to the distributor or customer.

Figure 15:
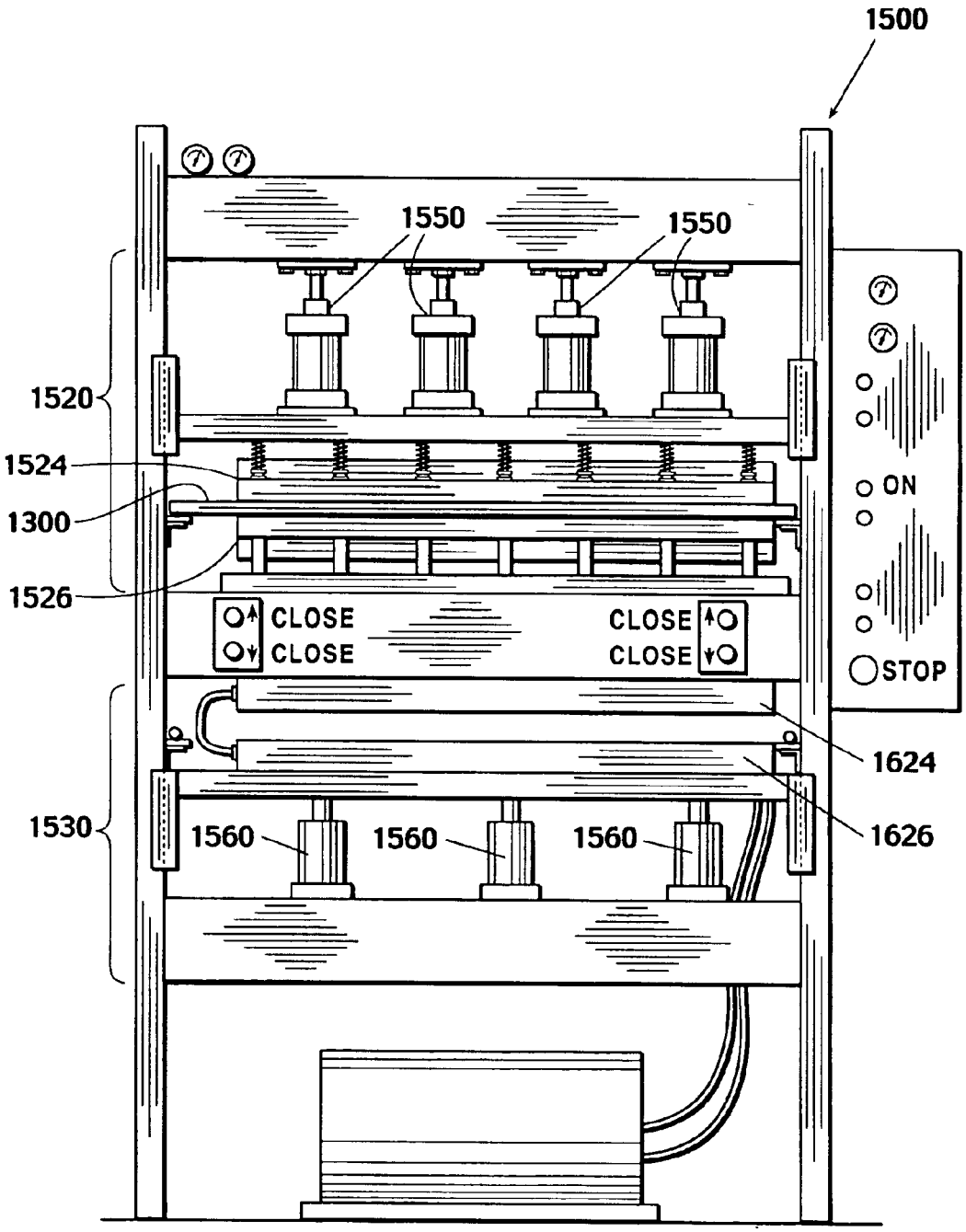
FIG. 15 illustrates a preferred manufacturing embodiment during its mat sealing/vacuum cycle.
Figure 16:
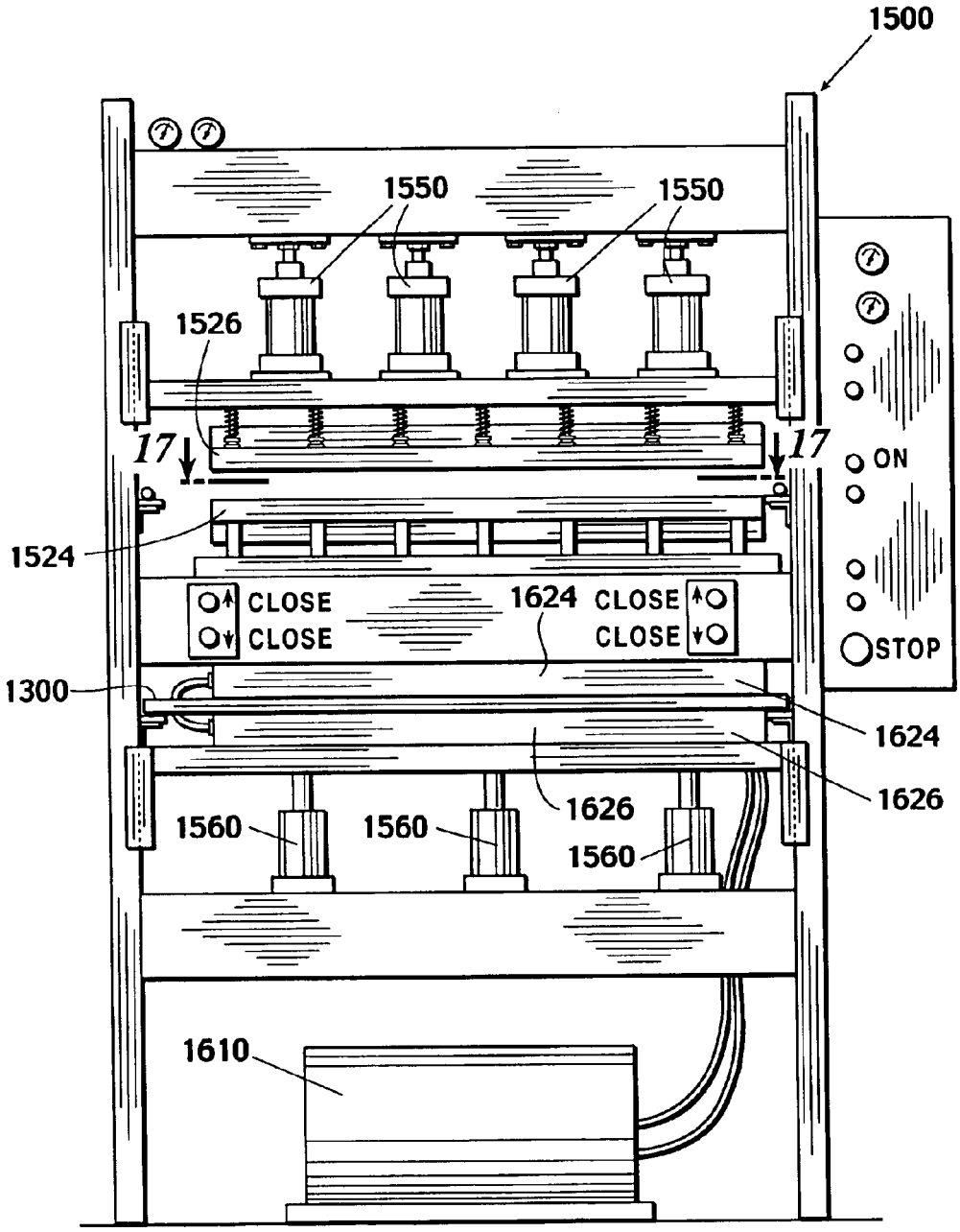
FIG. 16 illustrates a preferred manufacturing embodiment during its mat cooling cycle.

Turning now to a detailed discussion of the previous method and apparatus, as is generally illustrated in FIG. 15, the preferred apparatus for manufacture of the mat 500 consists of two elements: an upper heating/compression press 1520 and a lower cooling/compression press 1530. The embodiment of FIG. 15 has the assembly tray 1300 positioned in a closed press 1520, whereas the embodiment of FIG. 16 shows the same apparatus during the mat cooling stage, wherein the assembly tray 1300 is within the now-closed cooling press 1530. Pressure within cooling press 1530 is preferably provided by pneumatic rams 1560.

Figure 19:
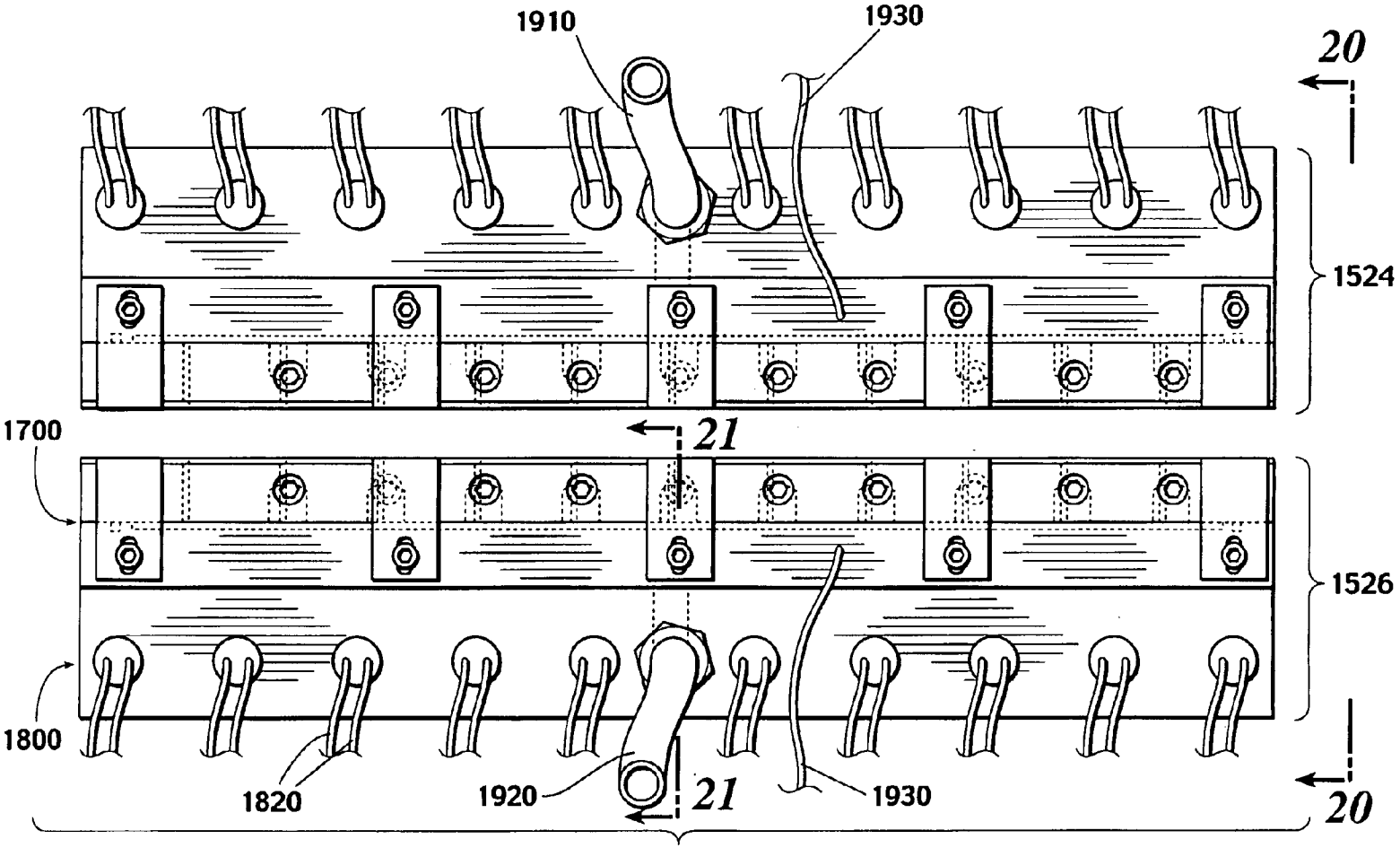
FIG. 19 contains a detailed rear view of the manufacturing platens.
Figure 21:
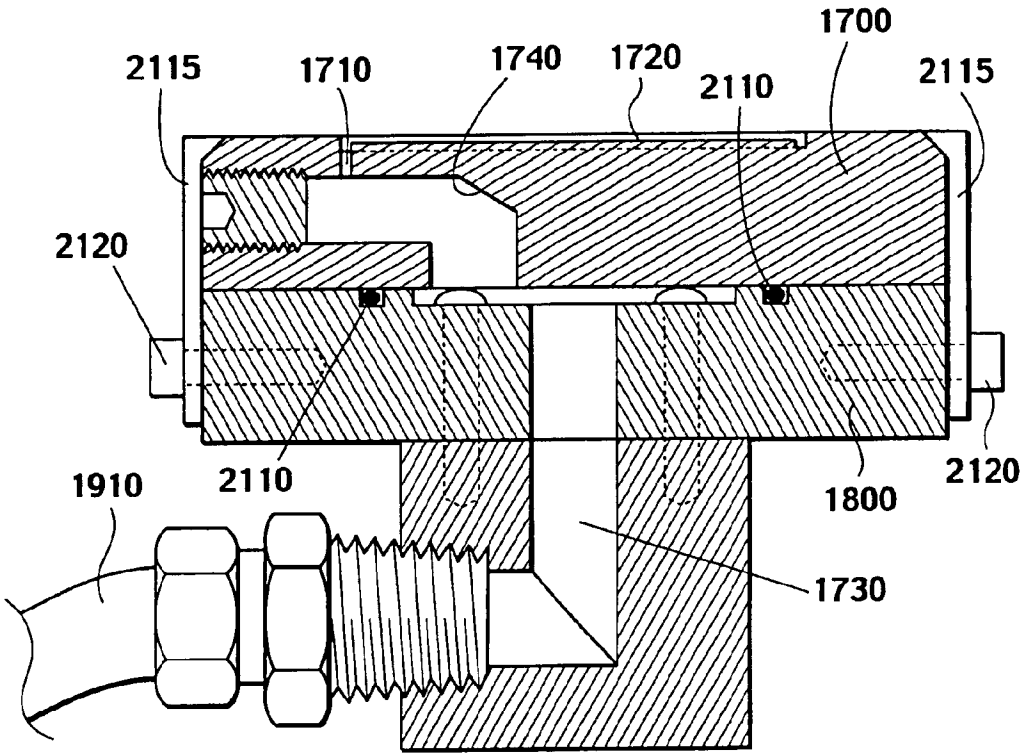
FIG. 21 contains a cross sectional view of the embodiment of FIG. 19.

FIG. 19 contains a rear view of upper press 1520, wherein the various elements thereof are more clearly set out. In the preferred embodiment, upper and lower platens 1524 and 1526 will be manufactured in two pieces, which in the case of lower platen 1526 are contact member 1700 and heating member 1800. Upper platen 1524 is similarly constructed. Additionally, note the presence of upper and lower vacuum lines 1910 and 1920 and thermocouple wires 1820, which preferably enter the platens 1524 and 1526 through the rearward side.

The upper press 1520 is preferably comprised of two platens 1524 and 1526, between which the assembly tray 1300 is positioned during the heating phase. The two platens are preferably compressed together through the use of multiple pneumatic rams 1550, which are positioned so as to apply pressure uniformly along the length of the platens.

Figure 17:
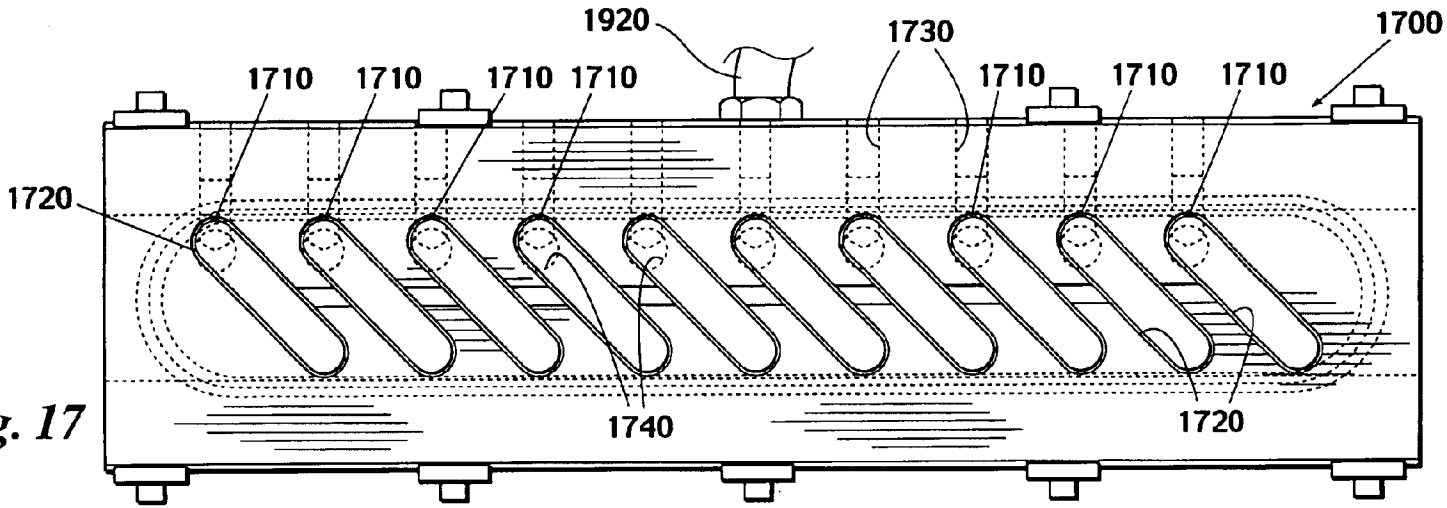
FIG. 17 contains a top-view illustration of a preferred upper platen embodiment which is used to create protrusions in the mat surface during manufacture.

FIGS. 17 through 21, and 23, contain additional details of the preferred platen embodiments. As is best seen in FIG. 17, platen 1524 is preferably comprised of two elements: an contact member 1700 and an heating member 1800. The upper surface of lower platen 1524 (i.e., the upper surface of contact member 1700) contains a plurality of indentations 1720 therein, which indentations shape the protrusions 535 as described hereinafter. Additionally, within each shaping indentation 1720 there is an aperture 1710 (best seen in FIG. 23) which is connected via passageways 1730 and 1740 to a remote vacuum source. Thus, when a vacuum is drawn through vacuum conduit 1920, the interior of each shaping indentation 1720, being in pneumatic/fluid communication with vacuum conduit 1920 through aperture 1710, will apply that vacuum to the mat components 1100 compressed therein.

Figure 18:
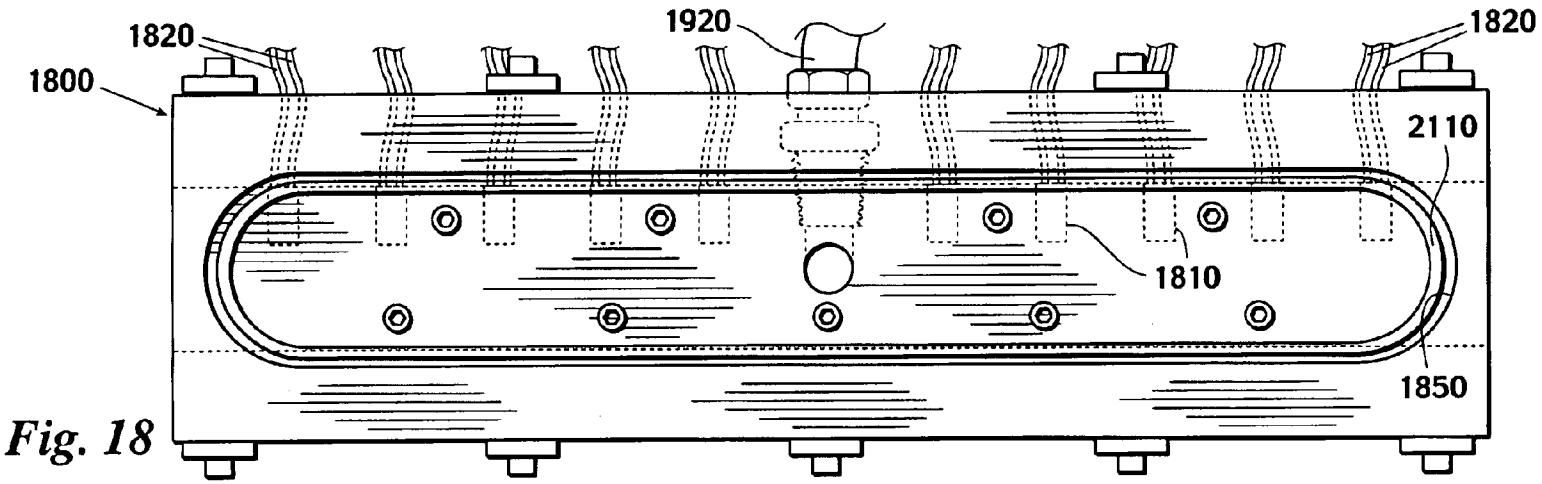
FIG. 18 illustrates a top view the platen of FIG. 17, wherein the top plate is removed is removed from the upper platen.

As can best be seen in FIG. 18, platen 1524 further contains heating elements 1810 within heating member 1800 which are designed to raise the temperature of the platen 1524 to the preferred temperature as is described hereinafter. (Note that the heating elements 1810 are not shown in FIG. 17 for purposes of clarity). In the preferred embodiment, the heating elements 1810 will be formed of electrically resistive materials and will be controlled by thermocouples 1930, although it should be clear to those of ordinary skill in the art that many other heating sources could certainly be used in the alternative. Additionally, o-ring 2110 which is situated within o-ring grove 1850 is used to seal the space between the two halves of platen 1524 so that, when a vacuum is pulled through vacuum line 1920, atmospheric air will not be drawn in through the contact region between the two members. Clearly, many other variations of this arrangement are certainly possible and have been specifically contemplated by the instant inventors.

Figure 20:
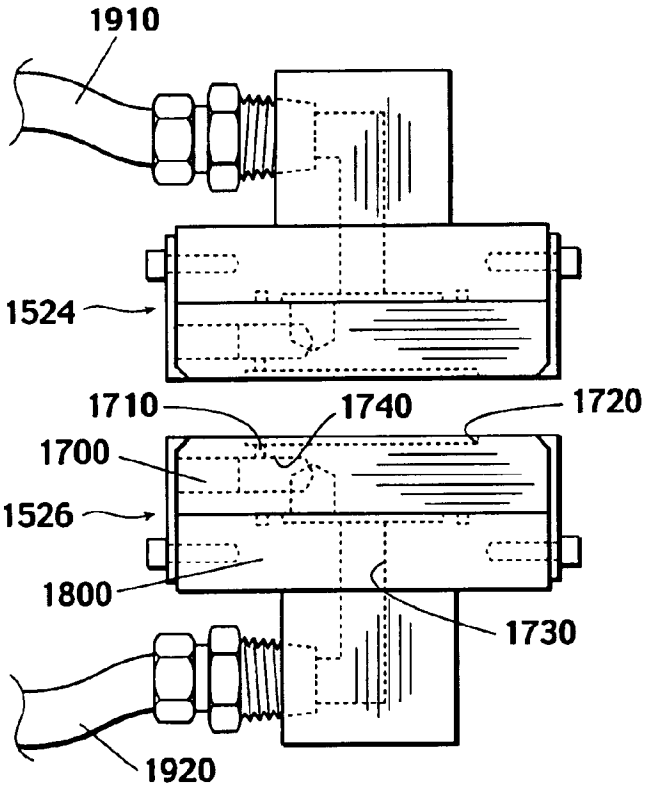
FIG. 20 contains an end view of the embodiment of FIG. 19.

FIG. 20 contains an end-view of the platen 1524, again with the heating elements 1810 omitted for purposes of clarity. As can be more clearly seen in this figure, vacuum line 1920 interconnects through passages 1730 and 1740 and aperture 1710 to the interior of the press 1520. Additionally, FIG. 21 contains a cross sectional view of lower platen 1524, which illustrates in even greater detail the preferred features of this element. As can be seen in this figure, the two halves (1700 and 1800) of the lower platen are preferably held together by clips 2115 which are affixed to the platen 1524 by some sort of fastener 2120. Further, the members 1700 and 1800 preferably, and as described previously in connection with FIG. 18, are made air tight at the point of their connection through the use of an o-ring 2110 which is designed to encircle the vacuum pathways within the platen 1526. The configuration of the airways by which vacuum line 1910 connects with the indentation 1720 through vacuum passages 1730 and 1740 to the indentations can now be more clearly seen.

Turning now to the method by which the mat is formed using the preferred apparatus discussed previously, the mat in the heating press 1520 is preferably heated to the glass transition temperature of the component parts and kept at that temperature during the time that vacuum is applied. Further, the heating is preferable bi-directional so that the mat is uniformly heated from both sides during sealing. This might be accomplished in many ways, but in the preferred embodiment both platens 1524 and 1526 are electrically heated to the requisite temperature before closing them onto the tray 1300. The temperature should be hot enough to allow the components in the assembly tray 1300 to partially melt and seal, but not so hot as to melt the mat layers. In the preferred case where the mat is some combination of alternating polyester and polyethylene layers, the temperature offered by example previously will melt the polyethylene layers and cause them to bind, without causing any permanent damage to the polyester layers.

Another reason for heating the mat assembly is to soften the upper 530 and lower 540 members so that protuberances 535 can be pulled into them. As is illustrated in FIG. 17, the platens 1524 and 1526 between which the mat is compressed preferably contain a pattern of indentions 1720 that will ultimately form the corresponding shapes in the completed mat. Clearly, by varying the width, depth, and location of the depressions 1720 corresponding changes may be made in the dimensions of the protuberances 535 in the finished product. Additionally, scattered throughout the platen 1700 are a plurality of apertures 1710 which are in fluid communication with a vacuum source (not shown). Note that the exact location, number, and depth of the depressions 1720 may be varied to suit the circumstances within the limits of physical limits of the mat material. Further note that since the periphery of platen 1700 is planar, the mat components 1100 will extend into that region will be compressed and heated at their respective peripheries, thereby forming a hermetic seal.

As was indicated previously, vacuum is introduced into the closed platens 1524 and 1526 by way of apertures 1710. The amount of vacuum that is needed to form the protuberances 535 will need to be determined empirically for each mat embodiment, as the particular combination of mat materials thickness, protuberance dimensions, heating temperature, etc., will all influence how much vacuum is necessary to pull apart the layers.

In operation, the heated press 1520 is closed on the tray 1300/mat combination. As the mat is heated, vacuum is applied. Although the preferred level of heat will not melt the polyester outer unit, it is sufficiently hot to soften it. Aided by this softening, the vacuum pulls apart the two outer members 530 and 540 and forces the material into the depressions 1720, thereby forming the depressions in the face of the mat. The platens 1524 and 1526 are then pulled apart and the tray 1300 containing the now-sealed mat is withdrawn.

Now, as a next preferred step, the mat is cooled within the cooling press 1530. Although this step is not strictly required, the instant inventors have determined that the quality of the final product will be improved by this step. As is generally illustrated in FIG. 16, the tray 1300 is placed between two platens that preferably have surfaces identical to those displayed in FIG. 17, i.e., that have depressions 1720 that correspond to those of the compression platens 1524 and 1526. This configuration helps maintain the outward extent of the protuberances 535 during cooling.

Preferably, the cooling unit 1610 will maintain the upper 1624 and lower 1626 cooling platens at about room temperature until the mat has cooled to the point where the protuberances 535 have stabilized. The cooling platens 1624 and 1626 might, for example, be either air cooled or water cooled, with the precise method of cooling being unimportant to the practice of the instant method. Of course, although it is preferred that the heating (1524 and 1526) and cooling (1624 and 1626) elements be separate platens, those skilled in the art will recognize that it would be possible to combine this functionality into a single element if that were desired.

As a final step, once the cooling unit 1610 has brought the temperature of the mat to approximately that of room temperature, the tray 1300 and the mat 1320 contained therein are removed from the cooling unit 1610. At room temperature, the materials that form the mat will have returned to their pre-heating resiliency, and the protrusions 535 that have been placed therein will be firm enough to be compressed many times before they become too fatigued to rebound. The now-cooled mat is then ready for labeling, packaging, and subsequent shipment to the distributor or buyer.

Preferred Apparatus and Method of Membrane Switch Manufacture

Turning now to a discussion of a preferred method of manufacturing the membrane switch 2410 described previously, sheets of polyester and polyethylene will preferably be arranged into a three-component "sandwich" (FIGS. 25 and 26), with the polyethylene layer 2510 being positioned between the two polyester layers 2505 and 2515, in preparation for heating and the application of vacuum. Additionally, it is preferable that the center/polyethylene layer 2510 be provided with one or more apertures 2525 therethrough. Additionally, it is preferred that the conductive regions 2530 and/or electrical leads 2540 be pre-applied to the upper 2505 and lower 2515 members before the package is placed within the press 1500, and further that the conductive regions be positioned in such a way as to be able to make contract through corresponding aperture 2525. Of course, it is understood that whatever material the conductive regions 2530 are imprinted or placed thereon (i.e., the inner surfaces of members 2505 and 2515), that material should itself be non-conductive to electricity.

The conducting regions 2530 will preferably be created by imprinting the opposing surfaces of the outer members 2505 and 2515 with a pattern of conductive (e.g., carbon-based) ink on that surface. That being said, those of ordinary skill in the art will recognize that many other alternatives are possible (e.g., aluminum/aluminized polyester, etc.). Of course, the only absolute requirement is that the conductive regions 2530 be capable of conducting an electrical current.

Those of ordinary skill in the art will recognize that information related to the function of a membrane switch is typically imprinted thereon, thereby assisting the user operate the attached piece of equipment. Similarly, it is preferable with respect to the instant invention that the outer surface of member 2405 contains some form of descriptive printing to label the membrane switches 2410.

As has been described previously, a contact member will be utilized in the formation of membrane switches 2410 which is similar to element 1700, except that the pattern of indentations created therein will be chosen so as to create protrusions of a size suitable for use as a membrane switch 2410. Additionally, in some cases, rather than manufacturing individual membrane switches 2410, it should be clear that interconnected arrays of such switches can similarly be produced by changing the template pattern incised into element 1700.

Finally, in operation the manufacturer of membrane switches 2410 will take place generally as described above, with the heated press 1520 preferably being closed on the layered combination 2400 while a vacuum is applied. The preferred level of heat will not melt the polyester outer unit but rather to will soften it so that protrusions may be formed therein by the application of vacuum.

Now, as a next preferred step, the switches 2400 will be cooled within the cooling press 1530. This configuration helps maintain the outward extent of the protuberances/switches 2410 during cooling. Preferably, the cooling unit 1610 will maintain the upper 1624 and lower 1626 cooling platens at about room temperature until the mat has cooled to the point where the protuberances 535 have stabilized.

As a final step, once the cooling unit 1610 has brought the temperature of the switches 2400 to approximately that of room temperature, the tray 1300 and the mat 1320 contained therein are removed from the cooling unit 1610. At room temperature, the materials that form the mat will have returned to their pre-heating resiliency, and the protrusions 2400 that have been placed therein will be firm enough to be compressed many times before they become too fatigued to rebound. The now-cooled switches are then ready for labeling (e.g., using pressure sensitive adhesive affixed to labels), packaging, and subsequent shipment to the distributor or buyer.

As is generally illustrated in FIG. 24, in a preferred embodiment 2400 multiple membrane switches 2410 will be formed during each cycle of the press 1500. Whether these membrane switches 2410 are designed to be used together as a unit or to be separated from one another and used separately is a design choice that is left up to the manufacturer.

Finally, although the preferred membrane switch 2410 will generally have a rounded summit with a circular base, those of ordinary skill in the art will recognize that many other shapes are possible, depending on the desires of the designer and the limits of the deformability of the materials from which it is made. For example, in some circumstances it might be desirable to have membrane switches that are roughly rectangular in dimension, in which case the indentations within the element 1700 would be shaped accordingly. In other instances, it might be desirable to have ridges or other textures placed atop the switch 2410 to help a user find the correct place to apply pressure. These and many other variations are well within the ability of one of ordinary skill in the art to devise.

It should be noted that after the instant switches 2410 are formed and sealed it may be desirable to be die cut them to separate them, after which pressure sensitive adhesive, double sided tape or similar attachment means will preferably be affixed to the mounting surface in preparation for their use in the field. Those of ordinary skill in the art will understand how such adhesives might be chosen and applied to suit the particular application and desires of the designer.

Figure 27:
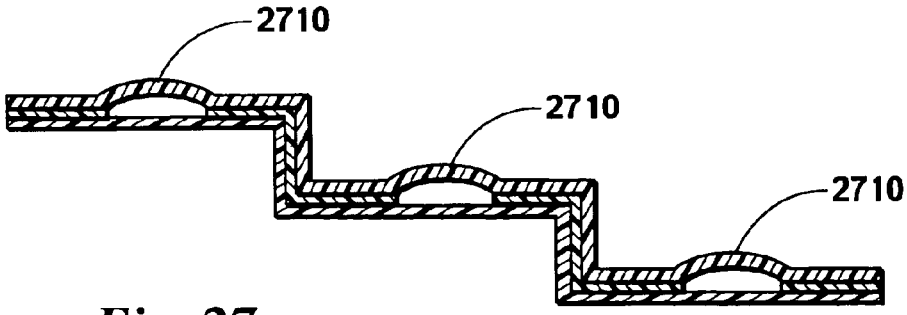
FIG. 27 contains a drawing of another preferred switch embodiment, wherein the switches conform to an arbitrary 3D surface.

Turning now to another preferred embodiment and as is set out in FIG. 27, there is provided a membrane switch 2710 substantially as described above, but wherein the switches are formed within a platen mold that has an arbitrary 3-D surface inscribed therein. That is, in the embodiment of FIG. 27 the switches 2710 have been formed in a stair-step configuration to illustrate one of the many ways that, depending on the pattern that is inscribed in the platen mold, three-dimensional switch banks can readily be developed. As has been described previously, the vacuum pressure that is applied to the heated mat components 2400 will tend to draw the heat-softened mat materials into whatever surface is incised into the platens. Although the preferred contact 1700 and heating 1800 members are generally flat and contain regions that have been sculpted to form and accommodate the protrusions, it should be clear that the any arbitrary 3-D surface might potentially be utilized.

Finally, those of ordinary skill in the art will recognize that membrane switches often contain within them an electrically conductive insert which provides tactile feedback to the user and also provides a restoring force that acts to return the switch to an open position after it has been pressed. Such inserts often take the form of thin low-profile metal dome-like structures (sometimes called snap domes) which are designed to precipitously collapse under pressure, thereby creating a snap or click which can be sensed by the user. Of course, the collapse of the dome is designed to coincide with the closure of the associated electrical circuit which allows a user to have some confidence that the selected switch has been engaged. With respect to the instant invention, preferably such inserts would be positioned in line with an aperture 2525 such that when a user presses on the switch 2410 the dome would collapse and bring the conductive regions 2530 into electrical communication with each other. Those of ordinary skill in the art will understand that such inserts can readily be positioned within the layered combination 2400 (within, for example, the openings 2525 in FIG. 25) prior to placing it in the press for heating and sealing. Heating and applying vacuum to the layered combination which contains appropriately positioned metal inserts therein will then result in a switch substantially as described above but which provides tactile feedback to a user when the switch is engaged.

CONCLUSIONS

It should be noted that the various temperatures, thicknesses, and other measurements noted previously are given only for purposes of illustration and should not be used to limit the practice of the subject matter claimed hereinafter. Additionally, although a series of alternating polyethylene/polyester layers is the preferred mat arrangement, those skilled in the art will recognize that many other variations are possible. It is critical, though, that whatever the chosen materials, that they be capable of being joined together along their peripheries to form a hermetic seal and that they be plastic enough to be deformed to form protuberances as has been described previously.

Further, it should be noted that the particular apparatus that is used to manufacture the preferred mat embodiment is one of only many that could be so arranged. Those skilled in the art will recognize that there are many other equipment variations and combinations that could be used to manufacture the preferred mat, including processes that would provide for large scale automation of the entire manufacturing process. In such a case, the single-mat press disclosed previously would be unnecessary, although the general steps that take place during the mat's preferred manufacturing process (e.g., heating, compression, vacuum, cooling, etc.) would need to be implemented on a larger scale.

Still further, those skilled in the art will recognize that the central spacer referred to herein need not be a discrete layer, but could instead be, by way of example, a discontinuous series of ridges, edges, or bumps which are positioned so as to separate the conductive surfaces. Further, a polyethylene layer could be made to serve as a central spacer, although that would not be preferred. What is essential, though, is that the central spacer be non-conductive, that it separates the two conductive faces of the outer members when there is no weight on the mat, and that it be sufficiently discontinuous to allow the conductive faces to come into contact when compressive pressure is applied to the mat. Thus, when the term "central spacer" is used herein, that term should be broadly construed to apply to any structure that satisfies the above-identified key requirements.

Additionally, it should be clearly noted that, although polyethylene and polyester are the preferred materials for use in constructing one embodiment of the mat of the instant invention, there are many other material combinations that could be used. It is critical, though, that the exterior materials be non-conductive so as to protect the patient from contact with the sensing current used by the electronic monitor; that the material allow for creation of two opposed conducting surfaces; and, that the materials used be malleable enough to be formed into protrusions as is described herein. Examples of other sorts of materials that might be used include, but not be limited to, polyethylene napthylate, polypropylenes, polycarbonates, high density polyethylene, polyurethane polystyrene, plastic impregnated textiles and webs, polyvinyl fluoride, plastic impregnated paper, ethylvinyl acetate, polyethylene, ethylene methyl acetate in mixture with ionimers, combinations of copolymers, ethylene acrylic acid, acetyl copolymers, laminates of any of the foregoing, etc.

Further, although the preferred embodiment of the instant mat contains protuberances symmetrically placed on opposite sides of the mat, it should be clear that is not an absolute requirement. Indeed, the instant inventors have specifically contemplated various asymmetric arrangements wherein, by way of example, protuberances are only formed into one side/member of the mat, wherein protuberances are formed in both halves of the mat but where the protuberances are not opposite each others (e.g., where a protuberance in one mat half faces a flat portion of the other mat member), etc. Thus, when the instant disclosure speaks of protuberances being formed in a mat, those words should be construed in their broadest sense to include symmetrically—as well as asymmetrically—placed extrusions.

Still further, it should be noted that the particular polyester/polyethylene combination utilized by the instant inventors is itself unique. That is, it would be possible to manufacture a mat that utilizes a structure analogous to that of the mat embodiment of FIGS. 3 and 4, but wherein the outer members 320 and 340 and inner spacer 310 are polyester/polyethylene combinations of the sort described previously herein. In this case, the inner spacer 310 would not be expected to be compressible, but that property is not strictly necessary and the resiliency of the outer members, acting along, would be sufficient to draw the two conductive faces apart when weight is removed from the mat.

Even further, although the preferred embodiment utilizes a polyethylene layer upon which has been deposited a conductive surface, it should be clear to those of ordinary skill in the art that the inner surface of the polyester layer could be used in the alternative, provided that the adhesive polyethylene layer has apertures therethrough to allow the conductive surfaces on the polyester layers to come into contact. For example the embodiment of FIG. 11 might be constructed by using a central spacer 510 made of polyethylene and two outer members 530 and 540 made of polyester upon which have been deposited conductive surfaces 610 and 620 respectively.

Still further, it should be noted that electrical line 55 should be understood in its broadest sense to include, not just multi-element electrical lines, but other data transmission modalities including optical fiber. Thus, for purposes of specificity herein, the term "electrical line" will be used to include conventional multi-element electrical lines as well as optical or other data transmission lines.

Finally, although the preceding text has occasionally referred to the electronic monitor of the instant invention as a "bed" monitor, that was for purposes of specificity only and not out of any intention to limit the instant invention to that one application. In fact, the potential range of uses of this invention is much broader than bed-monitoring alone and might include, for example, use with a chair monitor, a toilet monitor, or other patient monitor, each of which is configurable as a binary switch, a binary switch being one that is capable of sensing at least two conditions and responding to same via distinct electronic signals. In the preferred embodiment, those two conditions would be the presence of patient and the absence of a patient from a monitored area. It should be noted that the use of the term "binary" is not intended to limit the instant invention to use only with sensors that can send only two signal types. Instead, binary switch will be used herein in its broadest sense to refer to any sort sensor that can be utilized to discern whether a patient is present or not, even if that sensor can generate a multitude of other signals.

Thus, it is apparent that there has been provided, in accordance with the invention, a monitor and method of operation of the monitor that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A membrane switch for use in patient monitoring, comprising:

(a) an upper polyester member, said upper polyester member having an inner surface and an outer surface;

(b) a first polyethylene bonding member having an upper surface and a lower surface, said first bonding member upper surface being positionable to be in contact with said upper member inner surface, and, at least a portion of said first bonding member lower surface being electrically conductive;

(c) a second polyethylene bonding member having an upper surface and a lower surface, said second bonding member upper surface facing said first bonding member lower surface, at least a portion of said second bonding member upper surface being electrically conductive, (d) a nonconductive polyester central spacer positionable to be between said first bonding member and said second bonding member, said central spacer separating said electrically conductive portions of said first and second bonding members, and, allowing said electrically conductive portions of said first and second bonding members to come into contact when pressure is applied to said membrane switch;

(e) a lower outer member made of polyester, said lower outer member having an inner surface and an outer surface, said inner surface of said lower outer member being positionable to be in contact with said lower surface of said second bonding member; and, (f) an electrical line in electrical communication with said conductive portions of said first and said second bonding members, said electrical line having at least two electrically isolated conductors therein, wherein a first electrically isolated conductor is in electrical communication with said conductive portion of said first bonding member, and wherein a second electrically isolated conductor is in electrical communication with said conductive portion of said second bonding member.

2. A membrane switch according to claim 1, wherein said upper and lower polyester members, said first and second bonding members, and said central spacer are bonded together into a unit by heat.

3. A membrane switch according to claim 1, wherein said central spacer has at least one aperture therethrough, at least one of said at least one aperture allowing said electrically conductive portions of said first and second bonding members to come into contact through said at least one aperture when pressure is applied to said membrane switch.

4. A membrane switch according to claim 3, further comprising:

(g) at least one electrically conductive snap dome positionable within at least one of said at least one apertures and between said upper polyester member and said lower polyester member.

5. A switch bank, said switch bank comprising a plurality of membrane switches according to claim 1.

6. A switch bank according to claim 5, wherein at least two of said plurality of membrane switches are interconnected by one or more air passages.

7. A switch bank according to claim 6, wherein said air passages interconnecting said one or membrane switches indicate a preferred order in which said one or more membrane switches should be activated.

8. A method of manufacturing a membrane switch, comprising the steps of:

(a) obtaining an upper member, said upper member having an outer surface and an inner surface, wherein said upper member outer surface is electrically nonconductive, and, wherein at least a portion of said upper member inner surface is electrically conductive;

(b) obtaining a membrane switch lower member, said lower member having an inner surface and an outer surface, wherein said lower member outer surface is electrically nonconductive, and, at least a portion of said lower member inner surface is electrically conductive;

(c) obtaining a nonconductive central spacer, said central spacer having at least one aperture therethrough;

(d) placing said central spacer between said upper member and said lower member, wherein said conductive surfaces of said upper and lower members face each other across said central spacer;

(e) placing a first conductor in electrical communication with at least a portion of said upper member conductive region and placing a second conductor in electrical communication with at least a portion of said lower member conductive region;

(f) compressing together and heating said upper member, said lower member, and said central spacer; and, (g) applying vacuum pressure to said outer surface of said upper member sufficient to form at least one protuberance therein, wherein one ore more of said at least one protuberance forms a membrane switch.

9. A method according to claim 8 wherein the step of compressing together and heating said upper member, said lower member, and said central spacer includes the step of heating said upper member, said lower member, and said central spacer to a glass transition temperature.

10. A method according to claim 8, comprising the further step of:

(h) cooling said upper member, said lower member, and said central spacer to a temperature above said glass transition temperature.

11. A method according to claim 8, wherein said upper member inner surface contains a plurality of electrically isolated conductive regions thereon and said lower member inner surface contains a matching plurality of electrically isolated conductive regions, wherein step (e) comprises the steps of:

(e1) placing a first conductor in electrical communication with one of said electrically isolated conductive regions on said upper member inner surface, (e2) placing a second conductor in electrical communication with a matching one of said electrically isolated conductive regions on said lower member inner surface (e3) performing steps (e1) and (e2) at least twice for at least two different matching pairs of conductive regions on said upper and lower member inner surfaces.

12. An apparatus for manufacturing membrane switches, comprising:

(a) a vacuum source;

(b) an upper heating platen mold, said upper platen mold containing at least one depression therein and said upper heating platen mold at least for heating said membrane switch, said at least one depressions being in fluid communication with said vacuum source;

(c) a lower platen mold, said upper and lower platen molds being positionable together to contain said membrane switch therebetween, wherein said membrane switch has an interior, said interior of said membrane switch being in fluid communication with the atmosphere while between said upper and lower mold platens at least during heating;

(d) an upper cooling mold, said upper cooling mold containing a plurality of depressions matching said upper heating platen mold, said upper cooling mold at least for cooling said membrane switch after heating; and, (e) a lower cooling mold, said lower cooling mold positionable to be proximate to said upper cooling mold, said lower cooling mold at least for cooling said membrane switch after heating.

13. An apparatus for manufacturing membrane switches according to claim 12, wherein said lower platen mold is a heating platen mold, thereby resulting in the application of bi-directional heat.

14. An apparatus for manufacturing membrane switches according to claim 12, wherein said lower platen mold contains at least one depression therein, said at least one depression being in fluid communication with said vacuum source.

15. An apparatus for manufacturing membrane switches according to claim 13, wherein said lower platen mold contains a plurality of depressions matched to said plurality of depressions in said upper heating platen mold, wherein each of said plurality of depressions is in fluid communication with said vacuum source.

16. An apparatus for manufacturing membrane switches according to claim 12, wherein at least one of said upper platen mold and said lower platen mold contains an arbitrary 3-D surface formed therein.

17. An apparatus for manufacturing membrane switches according to claim 12, wherein at said upper platen mold and said lower platen mold are configured to form at least one switch bank therein, said at least one switch bank comprising a plurality of membrane switches for use together in a particular application.

18. An apparatus for manufacturing membrane switches according to claim 17, wherein at least two of said plurality of membrane switches are interconnected by one or more air passages.

19. An apparatus for manufacturing membrane switches according to claim 17, wherein said air passages interconnecting said one or membrane switches indicate a preferred order in which said one or more membrane switches should be activated.

* * * * *